US008449275B2

(12) United States Patent
Akamatsu et al.

(10) Patent No.: US 8,449,275 B2
(45) Date of Patent: May 28, 2013

(54) ROTOR DRIVE MECHANISM, ECCENTRIC SHAFT SEALING STRUCTURE, AND PUMP APPARATUS

(75) Inventors: Teruaki Akamatsu, Kyoto (JP); Mikio Yamashita, Kobe (JP); Nobuhisa Suhara, Ika-gun (JP)

(73) Assignee: Heishin Sobi Kabushiki Kaisha, Kobe-shi (JP)

( * ) Notice: Subject to any disclaimer, the term of this patent is extended or adjusted under 35 U.S.C. 154(b) by 838 days.

(21) Appl. No.: 12/530,419

(22) PCT Filed: Jan. 29, 2008

(86) PCT No.: PCT/JP2008/051314

§ 371 (c)(1),
(2), (4) Date: Oct. 20, 2009

(87) PCT Pub. No.: WO2008/108122

PCT Pub. Date: Sep. 12, 2008

(65) Prior Publication Data

US 2010/0040498 A1 Feb. 18, 2010

(30) Foreign Application Priority Data

Mar. 8, 2007 (JP) ..... 2007-058753

(51) Int. Cl.

| | |
|---|---|
| ***F01C 1/10*** | (2006.01) |
| ***F03C 2/00*** | (2006.01) |
| ***F03C 4/00*** | (2006.01) |
| ***F04C 2/00*** | (2006.01) |

(52) U.S. Cl.

USPC ..... 418/48; 418/182; 277/634; 277/635

(58) Field of Classification Search

USPC ..... 418/48, 182; 277/634–635

See application file for complete search history.

(56) References Cited

U.S. PATENT DOCUMENTS 2,915,979 A * 12/1959 Bourke et al. ..... 418/48
3,930,765 A * 1/1976 Waite ..... 418/48

(Continued)

FOREIGN PATENT DOCUMENTS

JP 49-111203 10/1974
JP 51-136051 11/1976

(Continued)

OTHER PUBLICATIONS

ISA Japan, International Search Report of PCT/JP2008/051314, Mar. 25, 2008, WIPO, 5 pages.

*Primary Examiner* — Theresa Trieu
(74) *Attorney, Agent, or Firm* — Alleman Hall McCoy Russell & Tuttle LLP

(57) ABSTRACT

A pump apparatus includes a first rotor drive mechanism configured to transfer rotation of an input shaft portion to an output shaft portion coupled to an external screw type rotor of a uniaxial eccentric screw pump, the input shaft portion being rotated with a central axis thereof kept in a certain position, and a uniaxial eccentric screw pump. The output shaft portion is rotatably provided via a bearing at a position eccentrically located with respect to the input shaft portion. The rotation of the input shaft portion is transferred through a first power transmission mechanism, including an inner gear, to the output shaft portion to cause the output shaft portion to carry out an eccentric rotational movement. The input shaft portion and the output shaft portion are arranged inside a pitch circle of the inner gear.

7 Claims, 15 Drawing Sheets

U.S. PATENT DOCUMENTS

| | | | | | |
|---|---|---|---|---|---|
| 4,237,704 | A | * | 12/1980 | Varadan | 418/48 |
| 4,591,322 | A | * | 5/1986 | Ono et al. | 418/48 |
| 5,857,842 | A | | 1/1999 | Sheehan | |

FOREIGN PATENT DOCUMENTS

| | | | | |
|---|---|---|---|---|
| JP | 56-34082 | | | 4/1981 |
| JP | 56-34083 | | | 4/1981 |
| JP | 60142078 | A | * | 7/1985 |
| JP | 60-162088 | | | 8/1985 |
| JP | 60-155785 | | | 10/1985 |
| JP | 05-087059 | | | 4/1993 |
| JP | 7-25285 | | | 5/1995 |
| JP | 11-311187 | | | 11/1999 |

* cited by examiner (a)

(b)

(a)

(b)

(c)

(d)

(e)

ROTOR DRIVE MECHANISM, ECCENTRIC SHAFT SEALING STRUCTURE, AND PUMP APPARATUS

TECHNICAL FIELD

The present invention relates to a rotor drive mechanism and an eccentric shaft sealing structure, which are applicable to a uniaxial eccentric screw pump capable of transferring various fluids, such as gases, liquids, and powder, and fluids containing fine particles, and also relates to a pump apparatus including the rotor drive mechanism and the eccentric shaft sealing structure.

BACKGROUND ART

One example of conventional pump apparatuses will be explained in reference to FIG. 15 (see Patent Document 1, for example). As shown in FIG. 15, a pump apparatus 1 includes a uniaxial eccentric screw pump 2 and a rotor drive mechanism 4 configured to rotate a rotor 3 provided in the uniaxial eccentric screw pump 2. The uniaxial eccentric screw pump 2 is configured such that the external screw type rotor 3 is inserted in an internal screw hole 5*a* of a stator 5. By rotating the rotor 3 in a predetermined direction, a fluid, such as a liquid, can be suctioned from a suction port 6, for example, held in a space between the rotor 3 and the stator 5, transferred, and then discharged from a discharge port 7. At this time, the rotor 3 carries out an eccentric rotational movement, i.e., rotates while carrying out a revolution movement about a central axis 8 of the stator inner hole 5*a* shown in FIG. 15. The rotor drive mechanism 4 causes the rotor 3 to carry out the eccentric rotational movement.

The rotor drive mechanism 4 shown in FIG. 15 includes an input shaft 9 which is rotated by a rotation driving portion (for example, an electric motor, not shown). The input shaft 9 is coupled to an output shaft 11 via a gear 10 and the like gears. The output shaft 11 is coupled to an end portion of the rotor 3.

To be specific, when the rotation driving portion rotates, the rotation of the rotation driving portion is transferred via the input shaft 9, the gear 10 and the like gears, and the output shaft 11 to the rotor 3, and the rotor 3 then carries out the eccentric rotational movement. With this, the fluid can be suctioned from the suction port 6 and discharged from the discharge port 7.

Next, the rotor drive mechanism 4 will be explained in detail in reference to FIG. 15. The input shaft 9 is rotatably provided on a casing 12 via bearings, and the first outer gear 10 is attached to the input shaft 9. The first outer gear 10 engages a second outer gear 13, and the second outer gear 13 is attached to a crank drum 14. The crank drum 14 is rotatably provided on the casing 12 via bearings. A crank shaft 15 is eccentrically and rotatably provided inside the crank drum 14 via bearings. The output shaft 11 is coupled to a left end portion of the crank shaft 15 in FIG. 15. A third outer gear 16 is provided at a right end portion of the crank shaft 15 in FIG. 15, and engages an inner gear 17. The inner gear 17 is fixedly provided on the casing 12.

In accordance with the rotor drive mechanism 4, since the output shaft 11 and the crank shaft 15 are provided on the same axis 18, and the central axis 18 of the crank shaft 15 is eccentrically provided with respect to the central axis 8 of the crank drum 14, the rotation of the crank drum 14 can cause the rotor 3 to revolve about the central axis 8 of the stator inner hole 5*a*.

Moreover, since the third outer gear 16 provided at one end portion of the rotor 3 engages the inner gear 17, the revolving rotor 3 can be caused to rotate. With this configuration, the fluid can be discharged from the discharge port 7 by rotating the rotor 3 attached to the stator inner hole 5*a*.

Patent Document 1: Japanese Laid-Open Patent Application Publication 60-162088

DISCLOSURE OF THE INVENTION

Problems to be Solved by the Invention

However, the conventional pump apparatus 1 shown in FIG. 15 is configured such that since the first outer gear 10 attached to the input shaft 9 engages the second outer gear 13 attached to the crank drum 14, and the third outer gear 16 provided on the crank shaft 15 engages the inner gear 17, the input shaft 9 is provided outside a pitch circle of the inner gear 17. As a result, even if the pitch circle of the inner gear 17 is reduced in size, the volume of the pump apparatus 1 becomes comparatively large by the input shaft 9 provided outside the inner gear 17 and the first outer gear 10 attached to the input shaft 9. Therefore, there is a certain limit to provide the pump apparatus 1 which is small in size, light in weight, and low in cost.

The present invention was made to solve the above problems, and an object of the present invention is to provide a rotor drive mechanism, an eccentric shaft sealing structure, and a pump apparatus, each of which is capable of transferring and filling fluids with high flow rate accuracy and a long operating life, and realizing small size, light weight, low cost, and energy saving.

Means for Solving the Problems

The invention includes a rotor drive mechanism adopting a gear system.

A rotor drive mechanism according to a first aspect of the invention is a rotor drive mechanism configured to transfer rotation of an input shaft portion to an output shaft portion coupled to an external screw type rotor of a uniaxial eccentric screw pump, the input shaft portion being rotated with a central axis thereof kept in a certain position, wherein the output shaft portion is rotatably provided via a bearing at a position eccentrically located with respect to the input shaft portion, the rotation of the input shaft portion is transferred through a power transmission mechanism including an inner gear to the output shaft portion to cause the output shaft portion to carry out an eccentric rotational movement, and the input shaft portion and the output shaft portion are arranged inside a pitch circle of the inner gear.

In accordance with the rotor drive mechanism according to this first aspect of the invention, the output shaft portion can be used by being coupled to the external screw type rotor of the uniaxial eccentric screw pump. To be specific, by rotating the input shaft portion in a predetermined direction, the rotation of the input shaft portion is transferred via the power transmission mechanism including the inner gear to the output shaft portion. Thus, the rotor can be caused to carry out the eccentric rotational movement. The eccentric rotational movement denotes that, for example, the rotor rotates while carrying out the revolution movement along an inner peripheral surface of the inner hole of the stator at a predetermined angular speed, and a direction of rotation of the rotor is opposite a direction of revolution of the rotor. By the eccentric rotational movement of the rotor, a space formed between the inner surface of the stator inner hole and the outer surface of the rotor moves from one of openings of the stator inner hole to the other opening thereof. Therefore, the fluid can be transferred in this direction. Since the input shaft portion and the output shaft portion are provided inside the pitch circle of the inner gear of the power transmission mechanism, each of the rotor drive mechanism and the pump apparatus including the drive mechanism can be reduced in size, weight, and cost.

Moreover, since the rotor can be caused to carry out the eccentric rotational movement along a certain path, the rotor and the inner hole of the stator can be formed such that the inner surface of the inner hole of the stator and the outer surface of the rotor do not contact each other, or these surfaces contact at appropriate contact pressure.

A rotor drive mechanism according to a second aspect of the invention is a rotor drive mechanism configured to transfer rotation of an input shaft portion to an output shaft portion coupled to an external screw type rotor of a uniaxial eccentric screw pump, the input shaft portion being rotated with a central axis thereof kept in a certain position, wherein the output shaft portion is rotatably provided via a bearing at a position eccentrically located with respect to the input shaft portion and the rotation of the input shaft portion is transferred through a power transmission mechanism including an inner gear and an eccentric joint to the output shaft portion to cause the output shaft portion to carry out an eccentric rotational movement.

In accordance with the rotor drive mechanism according to this second aspect of the invention, since the power transmission mechanism includes the eccentric joint, the number of planetary gears used in the power transmission mechanism can be reduced, and the noise generated by the engagement of the gears can be reduced. Other than the above, the second aspect of the invention functions in the same manner as the first aspect of the invention.

The invention also includes a rotor drive mechanism adopting a link system.

A rotor drive mechanism according to a third aspect of the invention is a rotor drive mechanism configured to transfer rotation of an input shaft portion to an output shaft portion coupled to an external screw type rotor of a uniaxial eccentric screw pump, the input shaft portion being rotated with a central axis thereof kept in a certain position, wherein the input shaft portion is coupled to the output shaft portion via an eccentric joint, a first shaft portion, and a second shaft portion the first shaft portion, the second shaft portion, and the output shaft portion are coupled to one another in this order so as to be eccentrically provided with respect to one another by predetermined eccentricities, the first shaft portion is rotatably supported by a first slide mechanism, and is movable in a first straight direction substantially perpendicular to a center axis of the first shaft portion, the second shaft portion is rotatably supported by a second slide mechanism, and is movable in a second straight direction substantially perpendicular to a center axis of the second shaft portion, and the first straight direction and the second straight direction are arranged to form a predetermined three-dimensional cross angle corresponding to an eccentricity between the first shaft portion and the second shaft portion.

In accordance with the rotor drive mechanism according to the third aspect of the invention, the output shaft portion can be used by being coupled to the external screw type rotor of the uniaxial eccentric screw pump. By rotating the input shaft portion in a predetermined direction, the rotation of the input shaft portion is transferred via the eccentric joint and the first and second shaft portions to the output shaft portion. Thus, the rotor coupled to the output shaft portion can be caused to carry out the eccentric rotational movement. The reason why the rotor carries out the eccentric rotational movement is because the first shaft portion and the second shaft portion are eccentrically coupled to each other by a predetermined eccentricity, the first and second shaft portions are rotatably supported by the first and second slide mechanisms, respectively, the first shaft portion is movable in the first straight direction substantially perpendicular to the center axis of the first shaft portion, the second shaft portion is movable in the second straight direction substantially perpendicular to the center axis of the second shaft portion, and the first straight direction in which the first shaft portion is movable and the second straight direction in which the second shaft portion is movable are arranged to form a predetermined three-dimensionally cross angle corresponding to the eccentricity between the first shaft portion and the second shaft portion. Moreover, since the gears are not required, the noise generated by the engagement of the gears can be eliminated. Other than the above, the third aspect of the invention functions in the same manner as the first aspect of the invention, so that an explanation thereof is omitted.

A rotor drive mechanism according to a fourth aspect of the invention is the rotor drive mechanism according to the third aspect, wherein the first slide mechanism includes a first shaft supporting portion configured to rotatably support the first shaft portion, a first slide portion coupled to the first shaft supporting portion, and a first guiding portion configured to guide the first slide portion in the first straight direction, and the second slide mechanism includes a second shaft supporting portion configured to rotatably support the second shaft portion, a second slide portion coupled to the second shaft supporting portion, and a second guiding portion configured to guide the second slide portion in the second straight direction.

In accordance with the rotor drive mechanism according to the fourth aspect of the invention, the first shaft portion of the first slide mechanism is link-coupled to the first guiding portion via the first shaft supporting portion and the first slide portion, and the second shaft portion of the second slide mechanism is link-coupled to the second guiding portion via the second shaft supporting portion and the second slide portion. With this, the rotor coupled to the output shaft portion can be caused to carry out the eccentric rotational movement.

The invention also includes a rotor drive mechanism adopting a screw type bearing system.

A rotor drive mechanism according to a fifth aspect of the invention is a rotor drive mechanism configured to transfer rotation of an input shaft portion to an output shaft portion coupled to an external screw type rotor of a uniaxial eccentric screw pump, the input shaft portion being rotated with a central axis thereof kept in a certain position, wherein the input shaft portion is coupled to the output shaft portion via an eccentric joint and a first bearing structure, the first bearing structure includes the output shaft portion which is substantially the same in shape and size as the external screw type rotor and an internal screw bearing portion which is substantially the same in shape and size as an internal screw type inner hole of a stator to which the external screw type rotor is rotatably attached, and a gap in a fit between the output shaft portion and the internal screw bearing portion is narrower than a gap in a fit between the external screw type rotor and the internal screw type inner hole of the stator, or the fit between the output shaft portion and the internal screw bearing portion is tighter than the fit between the external screw type rotor and the internal screw type inner hole of the stator.

In accordance with the rotor drive mechanism according to the fifth aspect of the invention, by rotating the input shaft portion, the rotation of the input shaft portion is transferred via the eccentric joint to the output shaft portion. Since the output shaft portion is formed as an external screw type, and is attached to the internal screw bearing portion, the output shaft portion can carry out the eccentric rotational movement. Then, since the external screw type rotor coupled to the output shaft portion is also attached to the internal screw type inner hole of the stator, it can carry out the eccentric rotational movement as with the output shaft portion. Here, the gap in the fit between the output shaft portion and the internal screw bearing portion is narrower than the gap in the fit between the external screw type rotor and the internal screw type inner hole of the stator, or the fit between the output shaft portion and the internal screw bearing portion is tighter than the fit between the external screw type rotor and the internal screw type inner hole of the stator. Therefore, by appropriately setting the fit between the output shaft portion and the internal screw bearing portion, the external screw type rotor can be caused to carry out the eccentric rotational movement along a predetermined path. Other than the above, the fifth aspect of the invention functions in the same manner as the first aspect of the invention, so that an explanation thereof is omitted.

A rotor drive mechanism according to a sixth aspect of the invention is the rotor drive mechanism of the fifth aspect, wherein a second bearing structure having the same configuration as the first bearing structure is provided at an end portion of the external screw type rotor which portion is opposite an end portion at which the first bearing structure is provided.

In accordance with the rotor drive mechanism according to the sixth aspect of the invention, since the first bearing structures are respectively provided at both end portions of the external screw type rotor, the amount of deflection of the external screw type rotor can be reduced. With this, positioning accuracy for causing the external screw type rotor to carry out the eccentric rotational movement along the predetermined path can be improved.

The invention also includes a seventh aspect which is an eccentric shaft sealing structure which is applicable to the rotor configured to carry out the eccentric rotational movement, for example.

An eccentric shaft sealing structure according to the seventh aspect of the invention is an eccentric shaft sealing structure configured to seal a gap between an eccentric shaft configured to carry out an eccentric rotational movement and a casing having a large-diameter hole through which the eccentric shaft is inserted to be able to carry out the eccentric rotational movement, wherein a gap between an outer peripheral portion of the eccentric shaft and an inner peripheral portion of the large-diameter hole is sealed by at least a diaphragm.

In accordance with the eccentric shaft sealing structure according to the seventh aspect of the invention, the eccentric shaft is rotated by, for example, the driving portion to carry out the eccentric rotational movement, and can cause, for example, the rotor, coupled to the eccentric shaft, to carry out the same eccentric rotational movement as the eccentric shaft. Moreover, in a case where the eccentric shaft carries out the eccentric rotational movement and the revolution movement, the diaphragm freely deforms with respect to the revolution movement of the eccentric shaft. Therefore, the gap between the eccentric shaft and the casing having the large-diameter hole through which the eccentric shaft is inserted so as to be able to carry out the eccentric rotational movement can be surely sealed.

An eccentric shaft sealing structure according to an eighth aspect of the invention is the eccentric shaft sealing structure according to the seventh aspect, and further includes a circular coupling portion having a small-diameter hole through which the eccentric shaft is rotatably inserted, wherein a gap between the outer peripheral portion of the eccentric shaft and an inner peripheral portion of the circular coupling portion is sealed by a third seal portion, and a gap between an outer peripheral portion of the circular coupling portion and the inner peripheral portion of the large-diameter hole is sealed by the diaphragm.

In accordance with the eccentric shaft sealing structure according to the eighth aspect of the invention, even in a case where the eccentric shaft rotates, an annular gap formed between the outer peripheral portion of the eccentric shaft and the inner peripheral portion of the circular coupling portion can be sealed by the third seal portion.

A pump apparatus according to a ninth aspect of the invention includes the rotor drive mechanism according to claim 1 the first aspect and the uniaxial eccentric screw pump, wherein the output shaft portion is coupled to the external screw type rotor, the external screw type rotor is rotatably attached to the inner hole of the stator, and the rotor drive mechanism causes the external screw type rotor to rotate with the external screw type rotor not contacting an inner surface of the inner hole of the stator.

In accordance with the pump apparatus according to the ninth aspect of the invention, the rotor and the stator can be rotated with the rotor and the stator not contacting each other. Therefore, in the case of transferring a fluid containing fine particles, for example, the gap between the rotor and the inner surface of the stator can be set such that the fine particles are not grated by the rotor and the inner surface of the stator, and the fine particles can be transferred while maintaining the original shapes of the fine particles. Thus, abrasion powder generated in a case where the rotor and the inner surface of the stator contact each other does not get mixed in the transfer fluid, and the noise generated by the friction between the rotor and the inner surface of the stator is not generated. Moreover, the gap between the outer peripheral surface of the rotor and the inner peripheral surface of the stator can be set to an appropriate size depending on the property of the transfer fluid (for example, a fluid containing fine particles or slurry). With this, depending on various properties of fluids, the pump apparatus can transfer and fill the fluid with high flow rate accuracy and a long operating life. Further, since the rotor and the stator can be rotated with the rotor and the stator not contacting each other, the rotor and the stator can be rotated at a comparatively high speed, so that a comparatively high transfer ability can be obtained.

A pump apparatus according to a tenth aspect of the invention is the pump apparatus of the ninth aspect, wherein the output shaft portion is coupled to the external screw type rotor via a flexible rod, and the flexible rod is formed to be deformable such that contact pressure between the external screw type rotor and the inner surface of the inner hole of the stator does not deteriorate a quality of a transfer fluid transferred by the pump apparatus.

In accordance with the pump apparatus according to the tenth aspect of the invention, for example, in a case where a force of pressing the external screw type rotor to the inner surface of the inner hole of the stator is generated during the operation of the pump apparatus, the flexible rod can deform such that the quality of the transfer fluid transferred by the pump apparatus is not deteriorated by the contact pressure between the external screw type rotor and the inner surface of the inner hole of the stator.

A pump apparatus according to an eleventh aspect of the invention is the pump apparatus of the tenth aspect, wherein the transfer fluid is a liquid containing fine particles, the flexible rod and the external screw type rotor are made of synthetic resin, and the flexible rod is formed to be deformable such that the fine particles are not damaged.

In accordance with the pump apparatus according to the eleventh aspect of the invention, since the flexible rod is made of synthetic resin, the liquid containing comparatively soft fine particles can be transferred while preventing the fine particles from being grated. Examples of the fine particles are powder bodies, capsule-like bodies, and saclike bodies.

A pump apparatus according to a twelfth aspect of the invention includes the rotor drive mechanism of the first aspect, and the eccentric shaft sealing structure according of the seventh aspect, wherein the output shaft portion is the eccentric shaft, and is coupled to the external screw type rotor of the uniaxial eccentric screw pump, and the external screw type rotor is rotatably attached to the inner hole of the stator.

In accordance with the pump apparatus according to the twelfth aspect of the invention, the pump apparatus functions as explained with respect to the rotor drive mechanism of the first aspect and the eccentric shaft sealing structure of the seventh aspect, so that an explanation thereof is omitted.

A pump apparatus according to a thirteenth aspect of the invention is a pump apparatus configured to cause a rotation driving portion to rotate an external screw type rotor of a uniaxial eccentric screw pump via an output shaft portion to discharge a transfer fluid, wherein the output shaft portion is coupled to the external screw type rotor via a flexible rod, the external screw type rotor is rotatably provided such that a gap is formed between the external screw type rotor and an inner surface of an inner hole of a stator, and the flexible rod is formed to be deformable such that contact pressure between the external screw type rotor and the inner surface of the inner hole of the stator does not deteriorate a quality of the transfer fluid transferred by the pump apparatus.

In accordance with the pump apparatus according to the thirteenth aspect of the invention, the flexible rod functions as explained in the pump apparatus of the tenth aspect, so that an explanation thereof is omitted.

A pump apparatus according to a fourteenth aspect of the invention is the pump apparatus of the thirteenth aspect, wherein the transfer fluid is a liquid containing fine particles, the flexible rod and the external screw type rotor are made of synthetic resin, and the flexible rod is formed to be deformable such that the fine particles are not damaged.

In accordance with the pump apparatus according to the fourteenth aspect of the invention, the flexible rod functions as explained in the pump apparatus of the eleventh aspect, so that an explanation thereof is omitted.

A pump apparatus according to a fifteenth aspect of the invention includes a uniaxial eccentric screw pump in which an external screw type rotor is inserted in an internal screw type inner hole of a stator, the stator is rotatably supported, and the rotor is supported to be able to carry out a revolution movement with respect to the inner hole of the stator, wherein the rotor and the stator are individually rotated, and the rotor is caused to carry out the revolution movement with respect to the inner hole of the stator without rotating.

In accordance with the pump apparatus according to the fifteenth aspect of the invention, the rotor can be caused to carry out the revolution movement along the inner peripheral surface of the inner hole of the stator at a predetermined angular speed without rotating, and the stator can be caused to rotate in the direction of revolution of the rotor. As a result, the rotor can be caused to carry out the eccentric rotational movement. By the eccentric rotational movement of the rotor, the fluid can be transferred through the inner hole of the stator. Then, since the rotor carries out the eccentric rotational movement along a certain path, the rotor and the stator can be rotated such that the inner surface of the inner hole of the stator and the outer surface of the rotor do not contact each other, or such that these surfaces contact at an appropriate contact pressure.

Moreover, since the rotor does not rotate, the distortion of the rotor is less likely to occur. With this, it is possible to surely prevent the contact between the inner surface of the inner hole of the stator and the outer surface of the rotor, which contact occurs due to the distortion of the rotor. Therefore, the gap between these surfaces can be set with high accuracy. Moreover, the contact pressure between these surfaces can be set within a predetermined range with high accuracy.

A pump apparatus according to a sixteenth aspect of the invention is the pump apparatus of the fifteenth aspect, wherein a central axis of the inner hole of the stator and a central axis of rotation of the stator coincide with each other.

In accordance with the pump apparatus according to the sixteenth aspect of the invention, the center of gravity of the stator can be set at the central axis of rotation of the stator. Therefore, the vibration of the stator can be reduced at the time of the rotation of the stator. Since whirling of the inner hole of the stator does not occur, the volume of the stator can be reduced.

A pump apparatus according to a seventeenth aspect of the invention is the pump apparatus of the fifteenth aspect, wherein the rotor is revolvably supported via an eccentric shaft provided at one end portion of the rotor or via eccentric shafts respectively provided at both end portions of the rotor, and the eccentric shaft is driven by a driving portion to carry out the revolution movement.

In accordance with the pump apparatus according to the seventeenth aspect of the invention, the rotor may be configured to have a one-end-support structure in which the eccentric shaft provided at one end portion of the rotor is revolvably supported, or may be configured to have a both-end-support structure in which the eccentric shafts respectively provided at both end portions of the rotor are revolvably supported. In a case where the rotor has the both-end-support structure, the amount of deflection of the rotor can be extremely reduced. With this, as compared to the one-end-support structure, the accuracy of the gap between the inner surface of the inner hole of the stator and the outer surface of the rotor can be improved, and the accuracy of the contact pressure therebetween can also be improved.

A pump apparatus according to an eighteenth aspect of the invention is the pump apparatus of the fifteenth aspect, wherein the stator is rotatably provided inside a casing via a bearing, a gap between the stator that is a rotating portion and the casing that is a fixed portion is sealed by a cooled seal portion to prevent the bearing from contacting a transfer fluid transferred by the pump apparatus, and the cooled seal portion is cooled down by a cooling medium supplied through a cooling port provided at the casing or by cold transferred from a cooling electron element.

In accordance with the pump apparatus according to the eighteenth aspect of the invention, the cooled seal portion can prevent the transfer fluid, transferred by the pump apparatus, from contacting the bearing and prevent a lubricant of the bearing from getting mixed in the transfer fluid. Since the cooled seal portion is provided between the stator that is the rotating portion and the casing that is the fixed portion, the frictional heat is generated at a contact portion where the rotating portion and the fixed portion contact each other. However, the frictional heat can be cooled down by the cooling medium supplied through the cooling port. Or, the frictional heat can be cooled down by the cold transferred from the cooling electron element, such as a Peltier element. Therefore, since the cooled seal portion and the bearing can be prevented from being heated, the lives of the cooled seal portion and the bearing can be lengthened, and a need for maintaining and checking the cooled seal portion and the bearing can be reduced.

A pump apparatus according to a nineteenth aspect of the invention is the pump apparatus of the fifteenth aspect, wherein the rotor and the stator are rotated with the rotor and the stator not contacting each other.

In accordance with the pump apparatus according to the nineteenth aspect of the invention, since the rotor and the stator can be rotated with the rotor and the stator not contacting each other, the pump apparatus of the nineteenth aspect of the invention functions in the same manner as the pump apparatus of the ninth aspect of the invention. For example, in the case of transferring the fluid containing the fine particles, the gap between the rotor and the inner surface of the stator can be set such that the fine particles are not grated by the rotor and the inner surface of the stator, and the fine particles can be transferred while maintaining the original shapes of the fine particles.

A pump apparatus according to a twentieth aspect of the invention includes a uniaxial eccentric screw pump configured such that an external screw type rotor is rotatably attached to an inner hole of a stator, and a rotor drive mechanism configured to transfer rotation of an input shaft portion to an output shaft portion coupled to the external screw type rotor, the input shaft portion being rotated with a central axis thereof kept in a certain position, wherein in the rotor drive mechanism, the output shaft portion is rotatably provided via a bearing at a position eccentrically located with respect to the input shaft portion, and the external screw type rotor is rotated with the external screw type rotor and an inner surface of the inner hole of the stator not contacting each other.

In accordance with the pump apparatus according to the twentieth aspect of the invention, since the external screw type rotor can be rotated with the external screw type rotor and the inner surface of the inner hole of the stator not contacting each other, the pump apparatus according to the twentieth aspect of the invention functions in the same manner as the pump apparatus according to the ninth aspect of the invention.

Effects of the Invention

In accordance with the rotor drive mechanism of the first aspect, since the input shaft portion and the output shaft portion are provided inside the pitch circle of the inner gear of the power transmission mechanism, each of the rotor drive mechanism and the pump apparatus, including the rotor drive mechanism, can be reduced in size, weight, and cost. Therefore, the pump apparatus including the rotor drive mechanism can become widespread.

Moreover, the rotor can carry out the eccentric rotational movement along a certain path such that the inner surface of the inner hole of the stator and the outer surface of the rotor do not contact each other. Therefore, in the case of transferring the transfer fluid containing the fine particles, for example, the gap between the rotor and the inner surface of the stator can be formed such that the fine particles are not grated by the rotor and the inner surface of the stator, and the transfer fluid can be transferred while maintaining the original shapes of the fine particles.

The rotor can be rotated such that the inner surface of the inner hole of the stator and the outer surface of the rotor do not contact each other, or the inner surface of the inner hole of the stator and the outer surface of the rotor contact each other at appropriate contact pressure. Therefore, the abrasion of the rotor and the stator can be prevented or suppressed, and the power for rotating the rotor can be reduced.

In accordance with the rotor drive mechanism according to the second aspect of the invention, since the power transmission mechanism includes the eccentric joint, the number of planetary gears used in the power transmission mechanism can be reduced, and the noise generated by the engagement of the gears can be reduced. Therefore, a use environment can be improved.

In accordance with the rotor drive mechanism according to the third aspect of the invention, since the planetary gear and the inner gear are not required, the volume of the rotor drive mechanism can be comparatively reduced. This is because, in the case of using the planetary gear and the inner gear, these gears rotate around the input shaft portion and the output shaft portion, so that this rotation range defines the size of the rotor drive mechanism. Moreover, since the gears are not required, the noise generated by the engagement of the gears can be eliminated.

In accordance with the rotor drive mechanism according to the fifth aspect of the invention, the output shaft portion of the first bearing structure is substantially the same in shape and size as the external screw type rotor, and the internal screw bearing portion of the first bearing structure is substantially the same in shape and size as the internal screw type inner hole of the stator. Therefore, the external screw type rotor can be caused to carry out the eccentric rotational movement along the predetermined path with comparatively high accuracy by a simple configuration.

In accordance with the eccentric shaft sealing structure according to the seventh aspect of the invention, in a case where the eccentric shaft carries out the eccentric rotational movement and the revolution movement, the diaphragm freely deforms with respect to the revolution movement of the eccentric shaft. Therefore, the gap between the eccentric shaft and the casing having the large-diameter hole through which the eccentric shaft is inserted so as to be able to carry out the eccentric rotational movement can be surely sealed by an extremely simple configuration.

In accordance with the pump apparatus according to the ninth aspect of the invention, the rotor and the stator can be rotated with the rotor and the stator not contacting each other. Therefore, in the case of transferring the fluid containing the fine particles, for example, the fine particles can be transferred while maintaining the original shapes of the fine particles, i.e., while maintaining the quality of the fine particles.

In accordance with the pump apparatus according to the thirteenth aspect of the invention, for example, in a case where the force of pressing the external screw type rotor to the inner surface of the inner hole of the stator is generated during the operation of the pump apparatus, the flexible rod can deform such that the quality of the transfer fluid transferred by the pump apparatus is not deteriorated by the contact pressure between the external screw type rotor and the inner surface of the inner hole of the stator.

In accordance with the pump apparatus according to the fifteenth aspect of the invention, since the external screw type rotor does not rotate, the distortion of the rotor is less likely to occur. With this, the transfer fluid can be transferred while preventing the inner surface of the internal screw type inner hole of the stator to which the rotor is attached and the outer surface of the rotor from contacting each other. Then, the gap therebetween can be set with high accuracy. Therefore, in the case of transferring the fluid containing the fine particles, for example, the fine particles can be transferred such that the fine particles are not grated by the rotor and the inner surface of the stator while maintaining the original shapes of the fine particles. Then, since the rotor and the inner surface of the stator can be set with high accuracy such that the rotor and the inner surface of the stator contact each other at contact pressure within a predetermined range, the abrasion of the rotor and the stator can be suppressed, and the power for rotating the rotor can be reduced.

FIGS. 1(*a*) and 1(*b*) are diagrams for explaining a basic principle of a uniaxial eccentric screw pump included in a pump apparatus according to the present invention. FIG. 1(*a*) is a sectional view showing a cutting surface perpendicular to a central axis of a rotor. FIG. 1(*b*) is a longitudinal sectional view showing a cutting surface along the central axis of the rotor.

Figure 10:
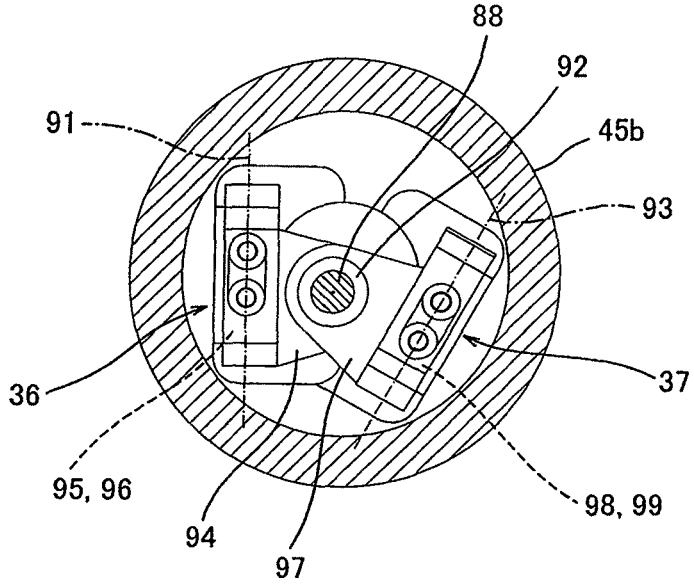
Figure 10:
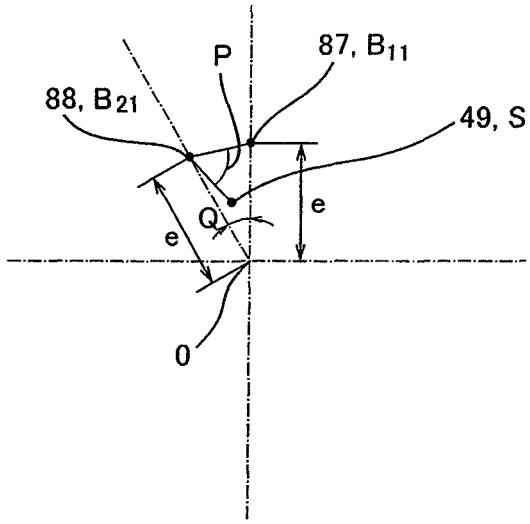

FIGS. 10(*a*) and 10(*b*) are diagrams showing first and second slide mechanisms included in the pump apparatus according to Embodiment 4. FIG. 10(*a*) is a front view, and FIG. 10(*b*) is a diagram showing a center of a first shaft portion, a center of a second shaft portion, and a center of an output shaft portion.

Figure 11:
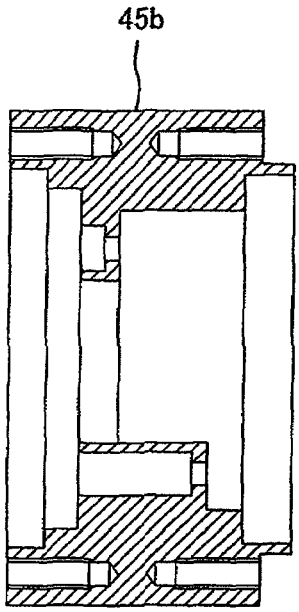
Figure 11:
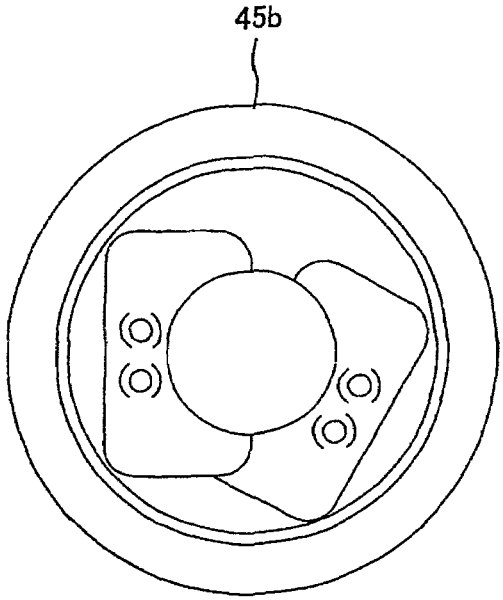
Figure 11:
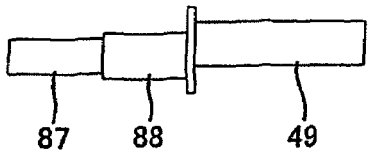
Figure 11:
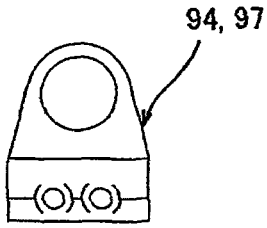
Figure 11:
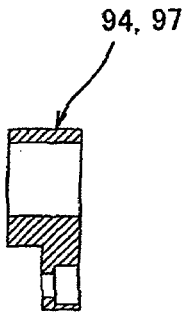

FIGS. 11(*a*)-(*e*) are diagrams showing components of the first and second slide mechanisms included in the pump apparatus according to Embodiment 4. FIG. 11(*a*) is a longitudinal sectional view of a slide attaching member. FIG. 11(*b*) is a front view of the slide attaching member. FIG. 11(*c*) is a front view of the output shaft portion, and first and second shaft portions coupled to the output shaft portion. FIG. 11(*d*) is a front view of a shaft supporting portion. FIG. 11(*e*) is a longitudinal sectional view of the shaft supporting portion.

Figure 12:
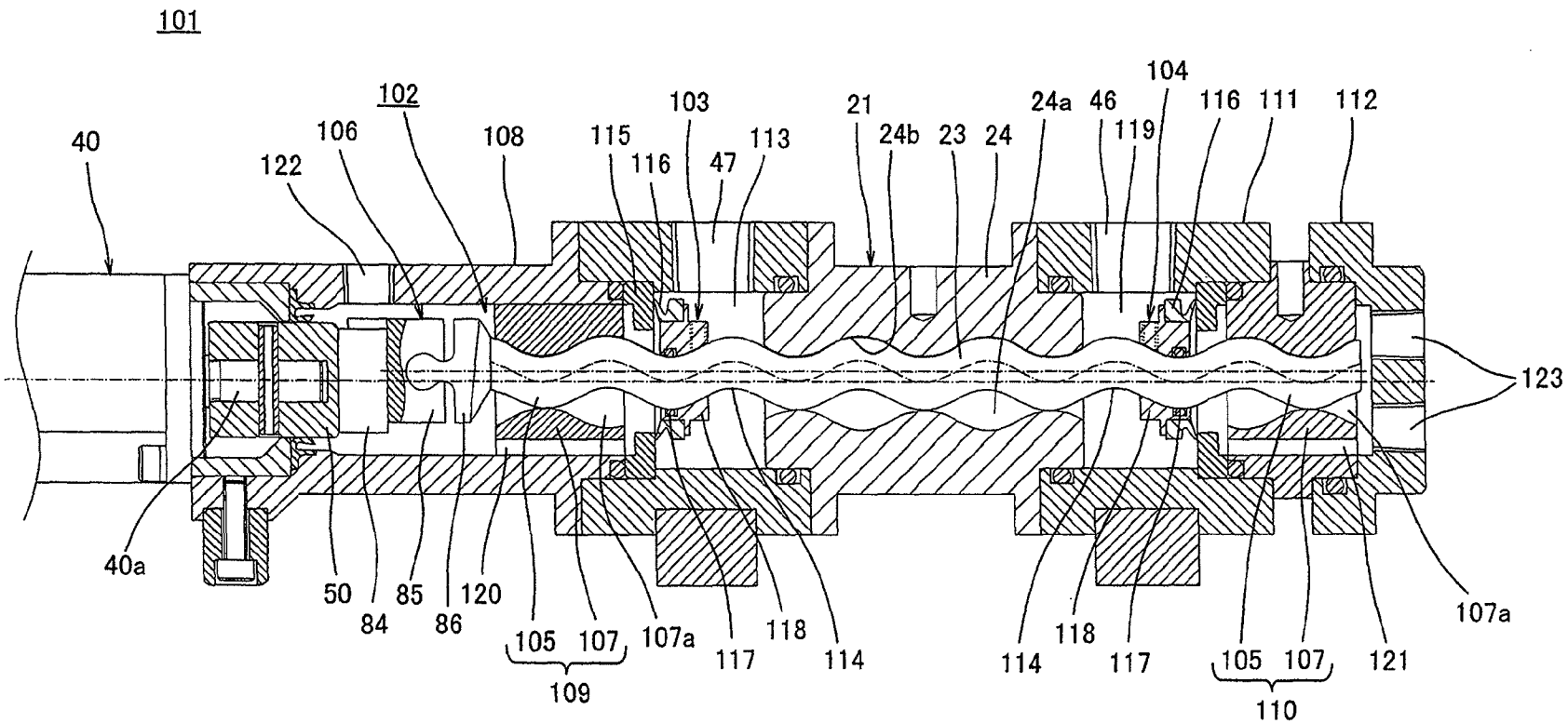

FIG. 12 is a longitudinal sectional view showing Embodiment 5 of the pump apparatus according to the present invention.

Figure 13:
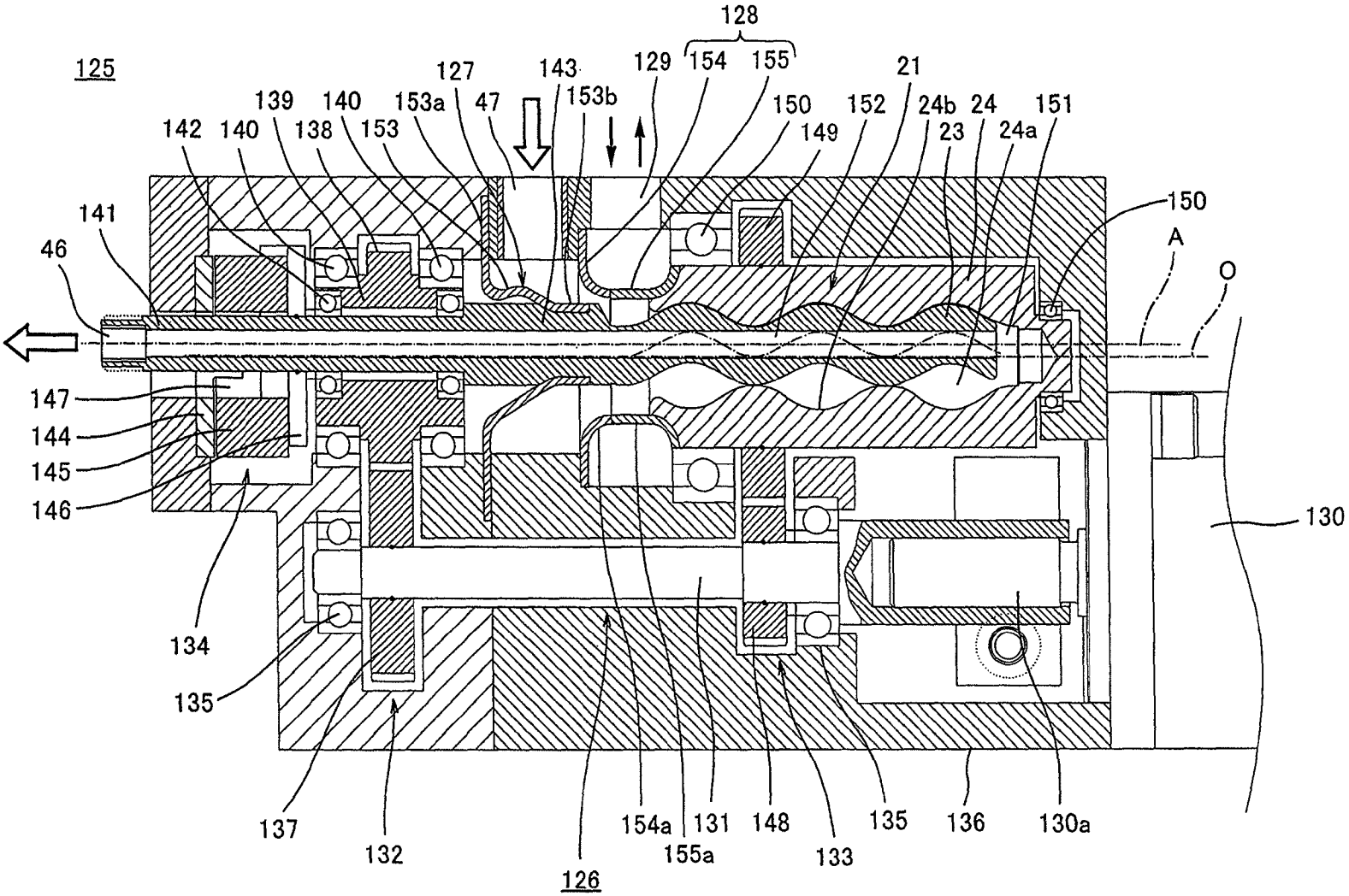

FIG. 13 is a longitudinal sectional view showing Embodiment 6 of the pump apparatus according to the present invention.

Figure 14:
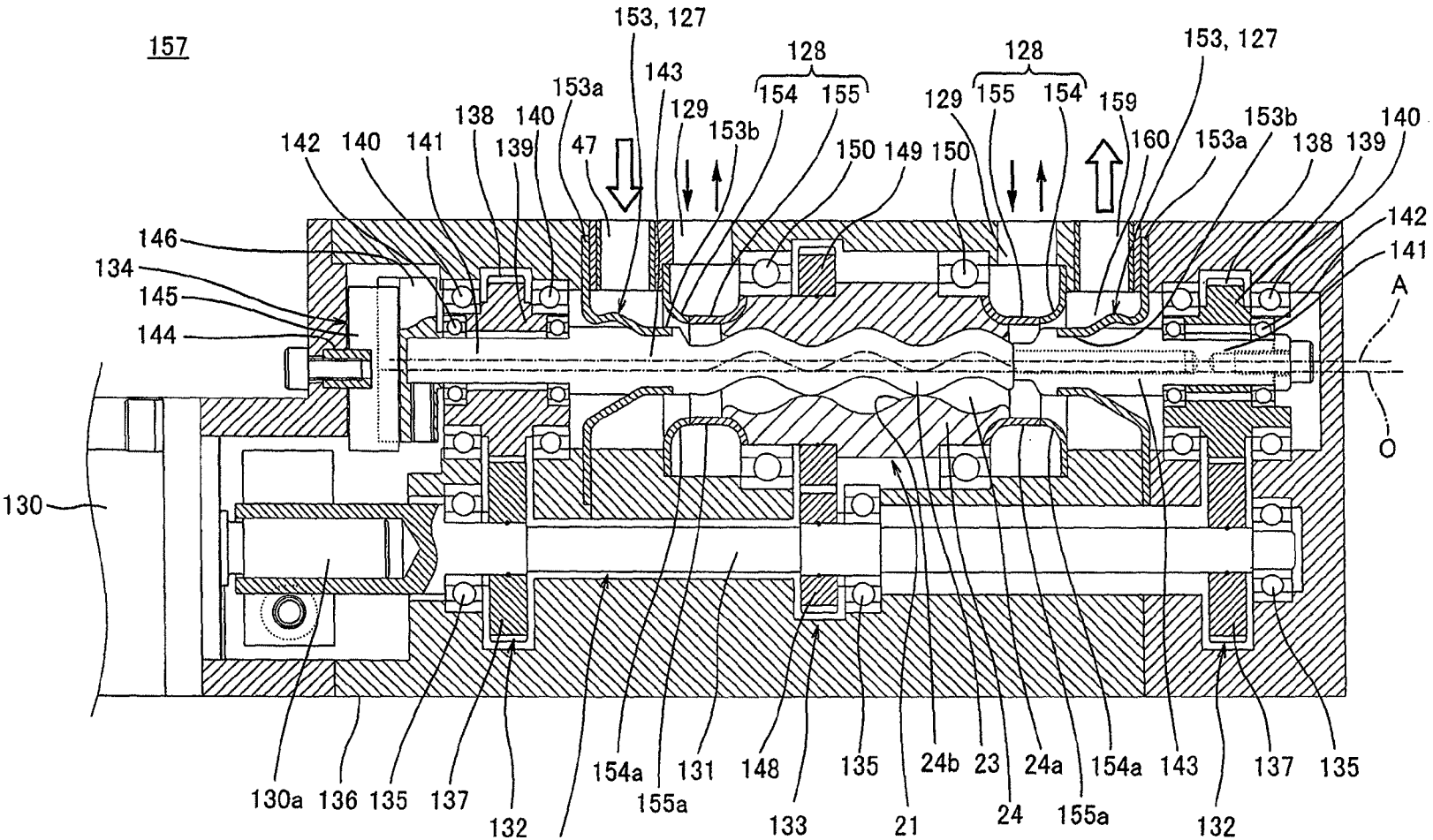

FIG. 14 is a longitudinal sectional view showing Embodiment 7 of the pump apparatus according to the present invention.

Figure 15:
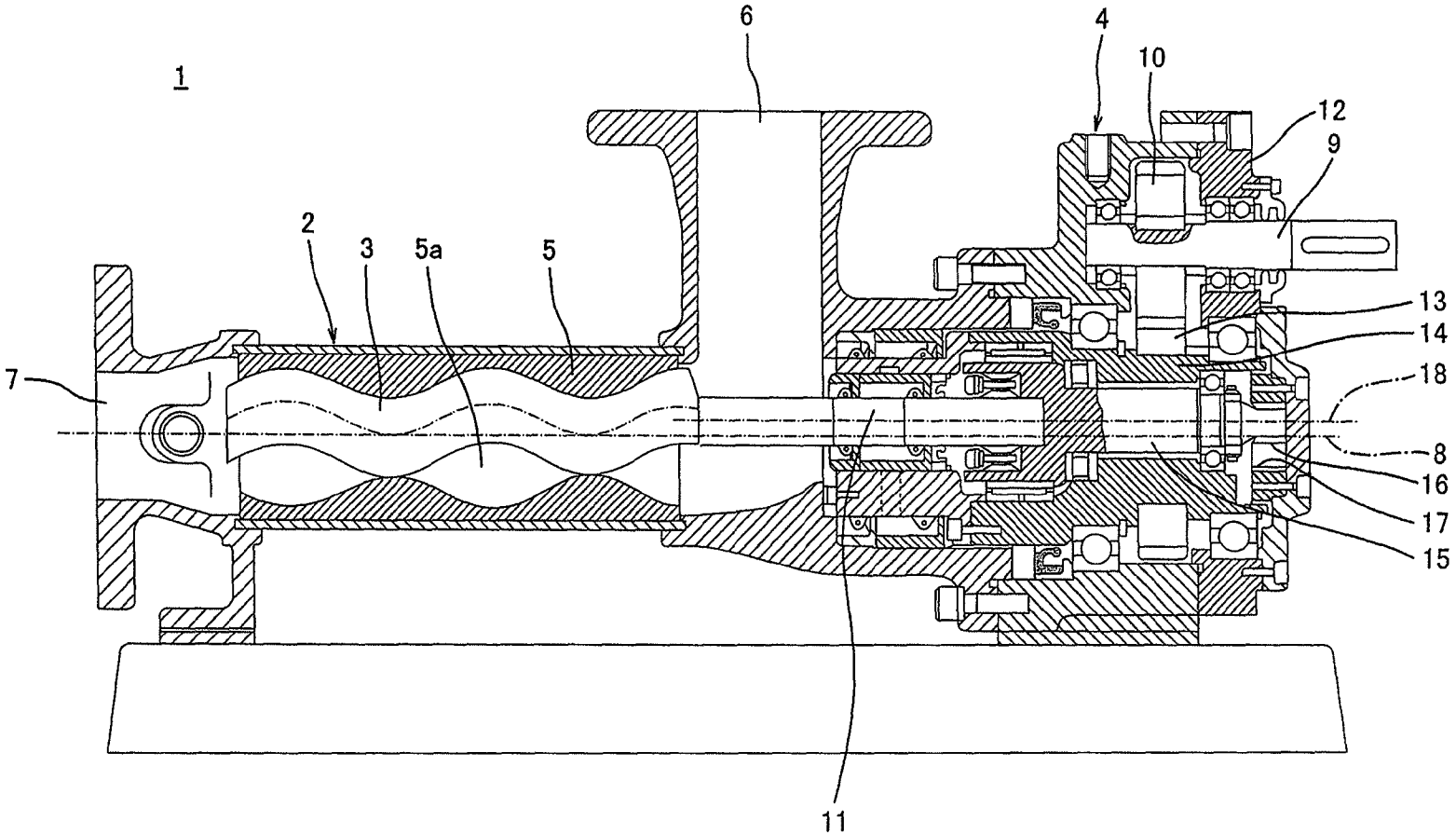
Fig. 15 PRIOR ART

FIG. 15 is a longitudinal sectional view of a conventional pump apparatus.

EXPLANATION OF REFERENCE NUMBERS

19 long axis
21 uniaxial eccentric screw pump
23 rotor
24 stator
24*a*, 107*a* inner hole
24*b* inner surface
27, 32 inner gear
28, 33 first planetary gear
29 second planetary gear
30 sun gear
34, 106 eccentric joint
36 first slide mechanism
37 second slide mechanism
39, 64, 68, 81, 101, 125, 157 pump apparatus
40 rotor driving portion
40*a* driving shaft
41 first rotor drive mechanism
41*a* first power transmission mechanism
42 first eccentric shaft sealing structure
43 second eccentric shaft sealing structure
44 nozzle
45, 136 casing
45*a* large-diameter hole
45*b* slide attaching member
46, 159 first opening
47 second opening
48, 75, 114, 143 rotor shaft
49, 105 output shaft portion (eccentric shaft)
50, 131 input shaft portion
51, 53, 54, 62, 70, 72, 74 bearing
89, 90, 92, 135, 140, 142, 150 bearing
52, 71 carrier
52*a* annular end portion (shaft supporting portion)
52*b* small-diameter hole
57 first seal portion
58 second seal portion
59 circular coupling portion
60 third seal portion
61, 153 diaphragm
65 intermediate shaft
66 flexible rod
69 second rotor drive mechanism
69*a* second power transmission mechanism
73 first shaft
76, 84 driving portion
76*a*, 77*a*, 77*b*, 78*a* engagement groove
77, 85, 145 intermediate portion
78, 86, 146 driven portion
79 steel ball
82 third rotor drive mechanism
83 eccentric joint
87 first shaft portion
88 second shaft portion
91 first straight direction
93 second straight direction
94 first shaft supporting portion
95 first slide portion
96 first guiding portion
97 second shaft supporting portion
98 second slide portion
99 second guiding portion
102 fourth rotor drive mechanism
103 third eccentric shaft sealing structure
104 fourth eccentric shaft sealing structure
107 internal screw bearing portion

108 first casing
109 first bearing structure
110 second bearing structure
111 second casing
112 third casing
113 second space portion
115 circular seal seat portion
116 fourth seal portion
117 fifth seal portion
118 circular seal attaching portion
119 first space portion
120, 121 pressure bypass port
122, 123 opening
126 fifth drive mechanism
127 fifth eccentric shaft sealing structure
128 cooled seal portion
129 cooling port
130 driving portion
130*a* driving shaft
132 rotor revolution drive mechanism
133 stator rotation drive mechanism
134 engagement mechanism
137 first outer gear
138 second outer gear
139 shaft supporting portion
141 eccentric shaft
144 fixing portion
147 through hole
148 third outer gear
149 fourth outer gear
151, 160 space
152 passage
153*a* outer peripheral edge portion of diaphragm
153*b* inner peripheral edge portion of diaphragm
154 fixed seal portion
154*a* tip end edge portion of diaphragm
155 rotating seal portion
155*a* tip end edge portion of diaphragm
158 sixth drive mechanism
O center of revolution of rotor
A central axis of rotor
B center of cross section of rotor
D1 to D4 cross-sectional position

BEST MODE FOR CARRYING OUT THE INVENTION

First, a basic principle of a pump apparatus 22 including a uniaxial eccentric screw pump 21 according to the present invention will be explained in reference to FIGS. 1 and 2.

1. Configuration of Pump Apparatus 22 Including Uniaxial Eccentric Screw Pump 21

Figure 1:
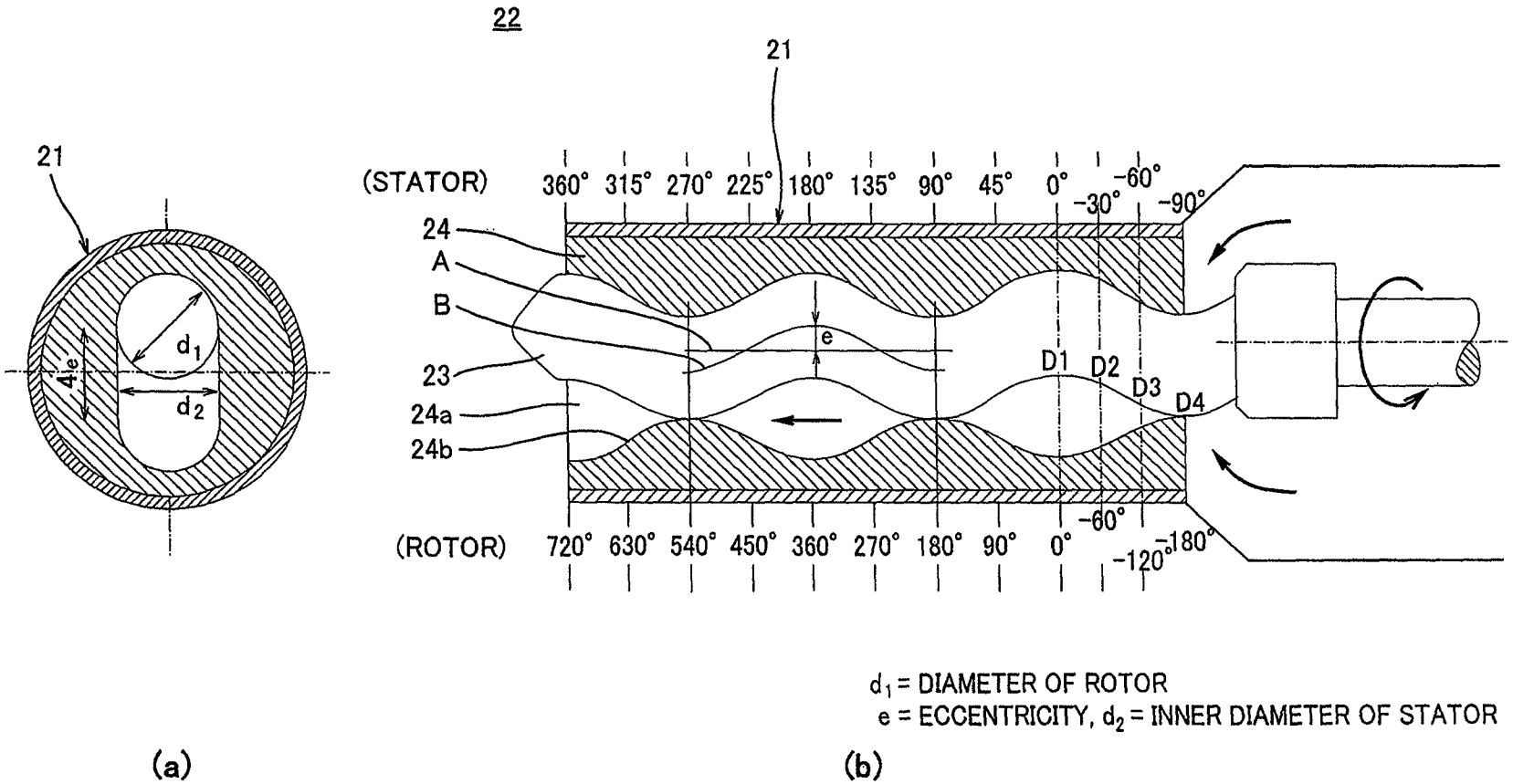

As shown in FIGS. 1(*a*) and 1(*b*), the uniaxial eccentric screw pump 21 is a rotary volume type pump, and includes an external screw type rotor 23 and a stator 24. The stator 24 has an internal screw type inner hole 24*a*, and the external screw type rotor 23 is attached to the inner hole 24*a*.

The stator 24 is formed to have a substantially short cylindrical shape having the inner hole 24*a* of a double thread internal screw shape, for example. A longitudinal cross-sectional shape of the inner hole 24*a* is elliptical. The stator 24 is made of engineering plastic (synthetic resin), such as TEFLON (trademark), polyacetal, or cast nylon.

The external screw type rotor 23 is formed to have a single thread external screw shape for example. A cross-sectional shape of the external screw type rotor 23 is a substantially perfect circle. A pitch of a spiral shape of the external screw type rotor 23 is set to half a pitch of the stator inner hole 24*a*. The rotor 23 is made of a metal, such as stainless steel, or synthetic resin.

2. Operating Principle of Uniaxial Eccentric Screw Pump 21, and Rotor Drive Mechanism FIGS. 1 and 2 show, for example, changes in state of the cross-sectional shape of the stationary stator 24 and the revolving and rotating rotor 23 at respective time points. FIG. 2 shows links connecting a center O of revolution of the rotor 23, a central axis A of the rotor 23, and a center B of a cross section of the rotor 23. Here, a link O-A and a link A-B are the same in length as each other.

Figure 2:
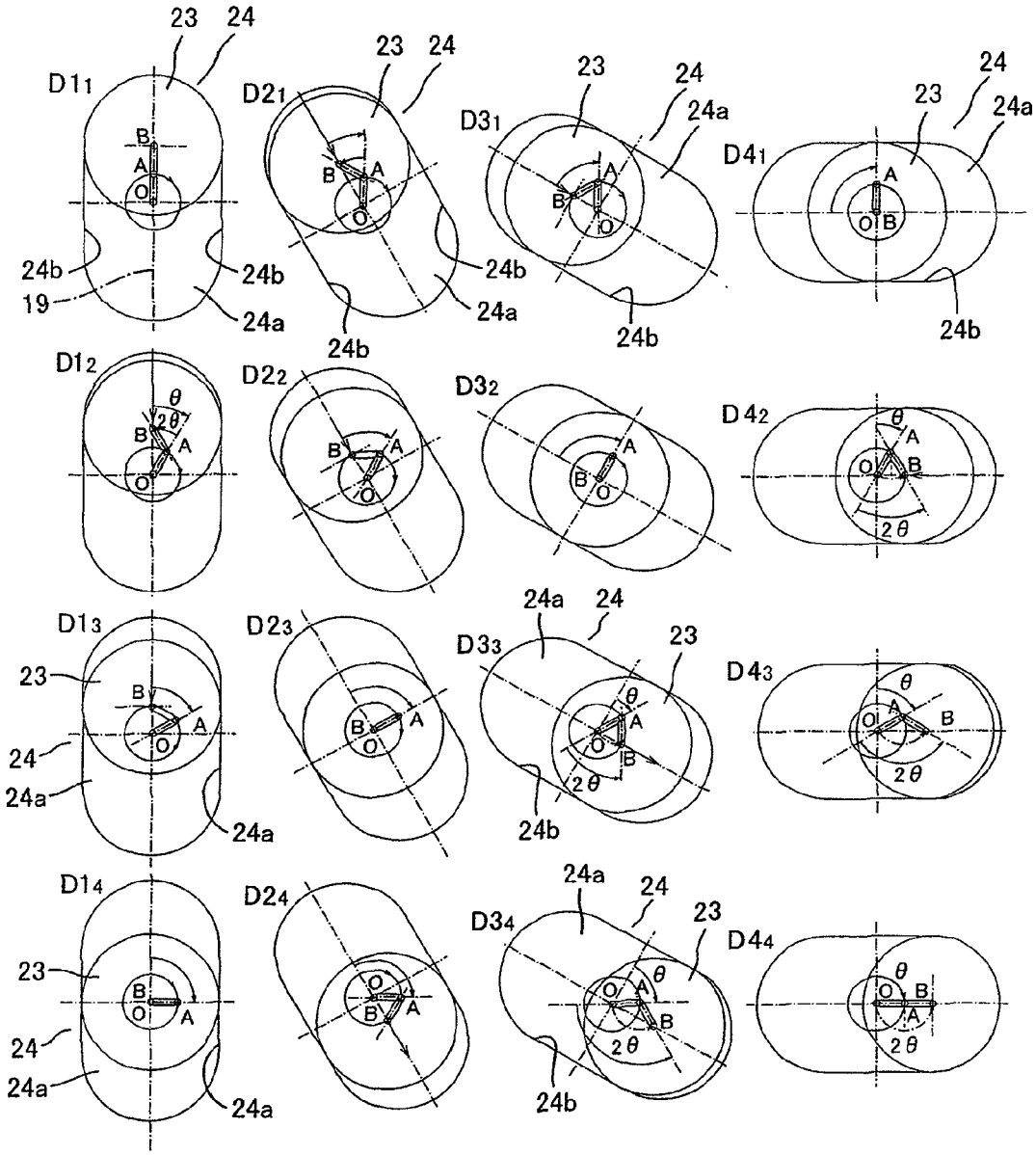
FIG. 2 is a schematic diagram showing a configuration of the uniaxial eccentric screw pump of FIG. 1, and is a sectional view showing cutting surfaces perpendicular to the central axis of the rotor at respective positions of the central axis of the rotor.

Cross-sectional views corresponding to cross sections D1, D2, D3, and D4 perpendicular to the central axis A of the rotor 23 shown in FIG. 1 are respectively shown in $D1_1$, $D2_1$, $D3_1$, and $D4_1$ of FIG. 2. $D1_1$, $D2_1$, $D3_1$, and $D4_1$ of FIG. 2 show respective positions of the center B of the cross section of the rotor 23 when a long axis 19 of the stator inner hole 24*a* inclines at 0 degree, 30 degrees, 60 degrees, and 90 degrees. Moreover, $D1_1$, $D1_2$, $D1_3$, $D1_4$, $D2_1$, $D2_2$, $D2_3$, $D2_4$, and the like of FIG. 2 show that the stator 24 is in a stop state, and the center B of the cross section of the rotor 23 moves along the long axis 19 of the cross section of the inner hole 24*a* of the stator 24 each time the central axis A of the rotor 23 revolves at 30 degrees.

From a different point of view, $D3_2$, $D3_3$, $D3_4$, $D4_1$, $D4_2$, $D4_3$, and $D4_4$ of FIG. 2 show that (i) each time the point A revolves around the point O at a revolving angle θ (30 degrees) in a normal direction, (ii) the point B is rotated around the point A in a reverse direction at an angle of 2θ, that is, twice the revolving angle θ, and (iii) this causes the point B to move straight along the long axis 19 of the cross section of the inner hole 24*a* of the stator 24. Here, the order of the operations (ii) and (iii) can be changed. To be specific, when carrying out the operation (i), the operation (iii) is caused to be carried out, i.e., the point B is caused to move straight along the long axis 19 of the cross section of the inner hole 24*a* of the stator 24. As a result, the operation (ii) can be caused to be carried out, i.e., the rotor 23 can be caused to rotate at 2θ. To be specific, without guiding the rotor 23 by an inner surface 24*b* of the stator inner hole 24*a*, it is possible to cause the rotor 23 to carry out a predetermined revolving and rotating eccentric rotational movement. As above, as a mechanism configured to cause the rotor 23 to carry out the eccentric rotational movement, there is a planetary gear mechanism (gear system) of the present invention which carries out the operations (i) and (ii), and a straight reciprocating movement mechanism (link system) of the present invention which carries out the operations (i) and (iii).

However, a deformation resistance of the stator inner hole 24*a* and a sliding friction resistance at the contact surface increase, and this increases a rotation drive power for rotating the rotor 23. In addition, for example, in a case where the conventional uniaxial eccentric screw pump transfers a liquid containing soft fine particles, the fine particles may be damaged.

To avoid this, a gap of an appropriate size is provided between the outer surface of the rotor 23 and the inner surface 24*b* of the stator inner hole 24*a* in one invention of the present invention (d1<d2). With this, the fine particles are not grated therebetween. Moreover, a fluid lubricating film is formed at the gap. With this, the sliding friction resistance can be significantly reduced, and this can reduce the rotation drive power for rotating the rotor 23. Therefore, it is possible to realize the pump apparatus 22 which is small in size, light in weight, low in cost, and energy saving.

The configuration for guiding the rotor 23 by the inner surface 24*b* of the stator inner hole 24*a* is not adopted herein. As a mechanism in which the gap is provided, there are the planetary gear mechanism (gear system) of the present invention and the straight reciprocating movement mechanism (link system) of the present invention, each of which causes the rotor 23 to revolve and rotate along a predetermined path.

4. Rotor Drive Mechanism

As a drive mechanism for causing the rotor 23 to carry out required revolution and rotation movements, there are the gear system of the present invention and the link system of the present invention.

Figure 3:
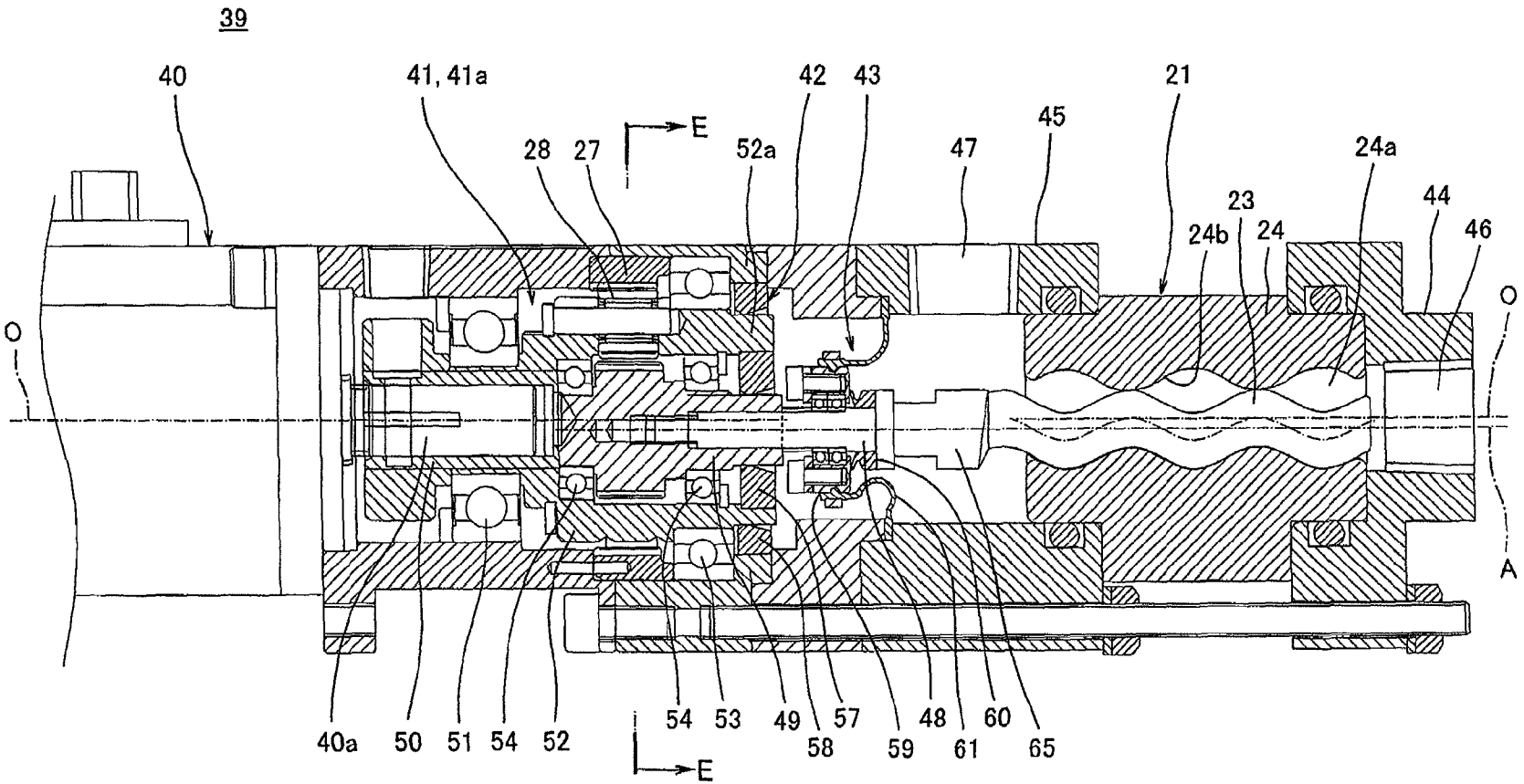
FIG. 3 is a longitudinal sectional view showing Embodiment 1 of the pump apparatus according to the present invention.
Figure 4:
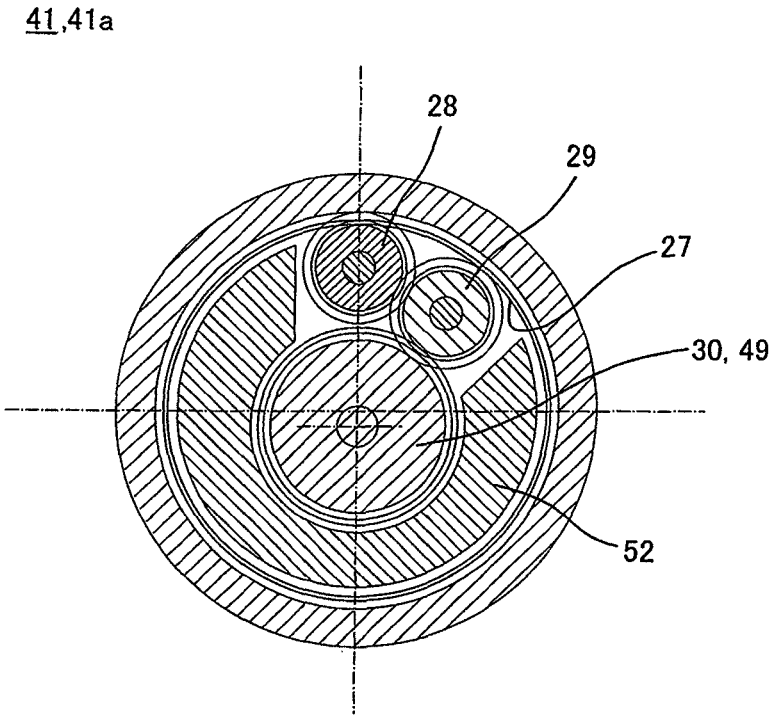
FIG. 4 is an E-E cross-sectional view of the pump apparatus according to Embodiment 1.
Figure 5:
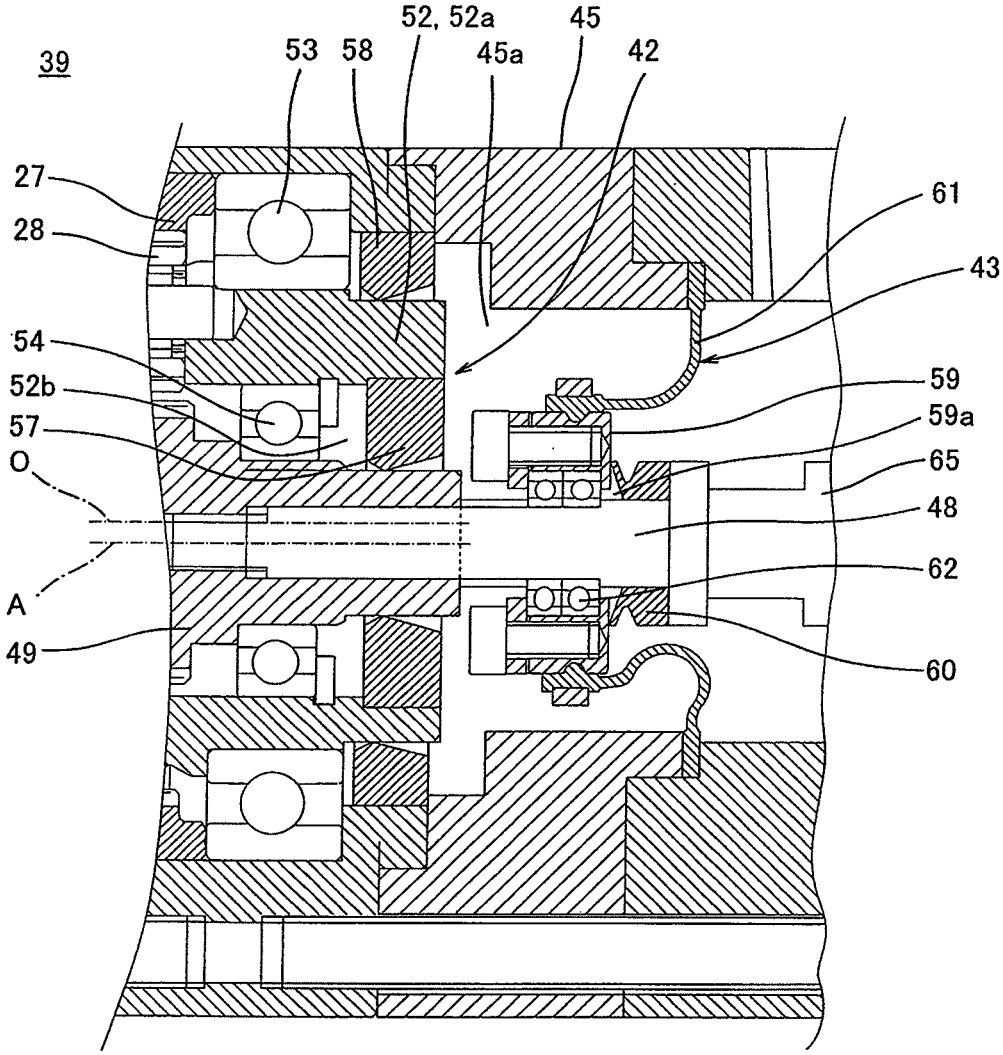
FIG. 5 is an enlarged longitudinal sectional view showing a second eccentric shaft sealing structure included in the pump apparatus according to Embodiment 1.

4-1. Gear System 4-1-1. As shown in FIGS. 3 to 5, a first gear system includes an inner gear 27, two planetary gears 28 and 29 provided inside the inner gear 27, and a sun gear 30. A pair of the inner gear 27 and the planetary gear 28 can cause the rotor 23 to carry out the revolution movement and the rotation (for example, rotation at an angle twice the revolving angle in a reverse direction), and the remaining planetary gear 29 can transfer the rotation to the eccentric rotor 23.

Figure 7:
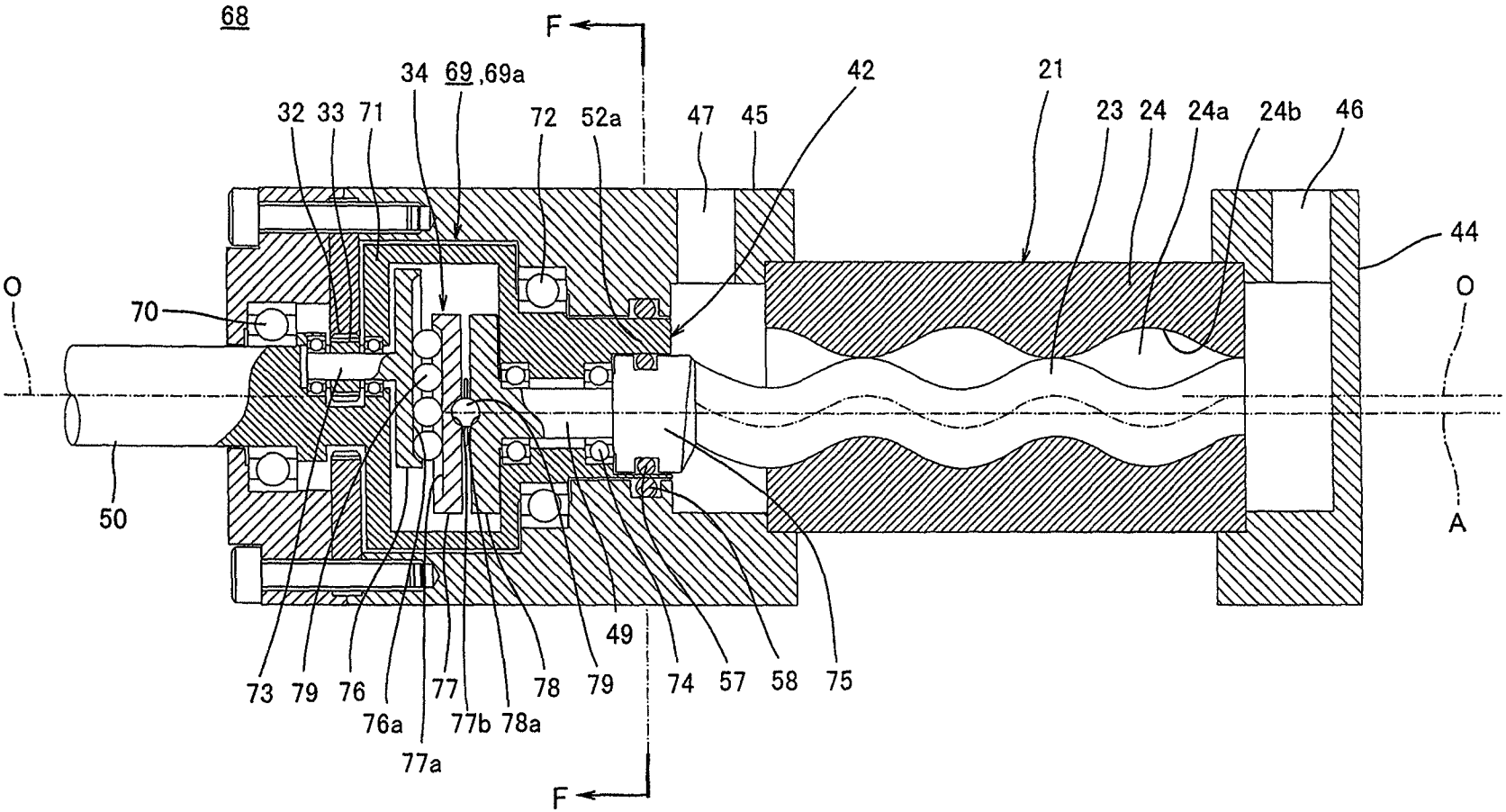
FIG. 7 is a longitudinal sectional view showing Embodiment 3 of the pump apparatus according to the present invention.

4-1-2. As shown in FIG. 7, a second gear system includes an inner gear 32, a planetary gear 33 provided inside the inner gear 32, and an eccentric shaft joint (Oldham coupling, for example) 34. A pair of the inner gear 32 and the planetary gear 33 can cause the rotor 23 to carry out the revolution movement and the rotation (for example, rotation at an angle twice the revolving angle in a reverse direction), and the eccentric joint 34 can transfer the rotation to the rotor 23 eccentrically provided with respect to the center of the planetary gear 33.

4-2. Link System

As shown by the cross sections of FIG. 2 showing the movements of the rotor 23 and the stator 24, the center B of the cross section of the rotor 23 moves on the long axis 19 as the central axis A of the rotor 23 revolves around the center O of the revolution movement of the rotor 23 in a state where the center B is restrained by the inner surface (direction along the long axis 19) 5*b* of the stator inner hole 24*a*. However, looking at the positions shown by $\mathbf{1}_4$ of FIG. 2, there is a possibility that the revolution movement of the point A loses the power for causing the point B to move along the long axis 19, the point B does not move in the direction along the long axis 19 and stays at the position of the point O, and only the point A revolves around the point O.

However, looking at $\mathbf{2}_4$ of FIG. 2, since the inner surface (direction along the long axis 19) 5*b* of the stator inner hole 24*a* inclines at 30 degrees with respect to a vertical direction, and the point B is restrained to move along the long axis 19, the point B can move in the direction along the long axis 19 without staying at the point O in $\mathbf{1}_4$ of FIG. 2.

Therefore, in the uniaxial eccentric screw pump 21 shown in FIGS. 1 and 2, a link mechanism of O, A, and B can be caused to continuously operate by restraining the movement of the point B in each of two cross sections, such as D1 and D2, D1 and D3, or D2 and D3, in the direction along the long axis 19 in each cross section. To be specific, for example, a first slide mechanism 36 of the present invention shown in FIGS. 9 and 10 restrains the point B such that the point B moves from $\mathrm{D}\mathbf{1}_1$ to $\mathrm{D}\mathbf{1}_4$ of FIG. 2 without staying at the same position. Then, for example, a second slide mechanism 37 of the present invention shown in FIGS. 9 and 10 restrains the point B such that the point B moves from $\mathrm{D}\mathbf{2}_1$ to $\mathrm{D}\mathbf{2}_4$ of FIG. 2 without staying at the same position.

4-3. Next, the Comparison Between the Gear System and Link System of the Rotor Drive Mechanism Will be Explained.

In the gear system, since a diameter of a pitch circle of a gear, such as the inner gear 27 shown in FIG. 3, becomes large in proportion to an eccentricity (revolution radius) e of the eccentric rotational movement of the rotor 23, a mechanical movement of the rotor drive mechanism may become larger than that of the rotor 23. It becomes especially large in a case where the rotor diameter d1 is small.

Figure 9:
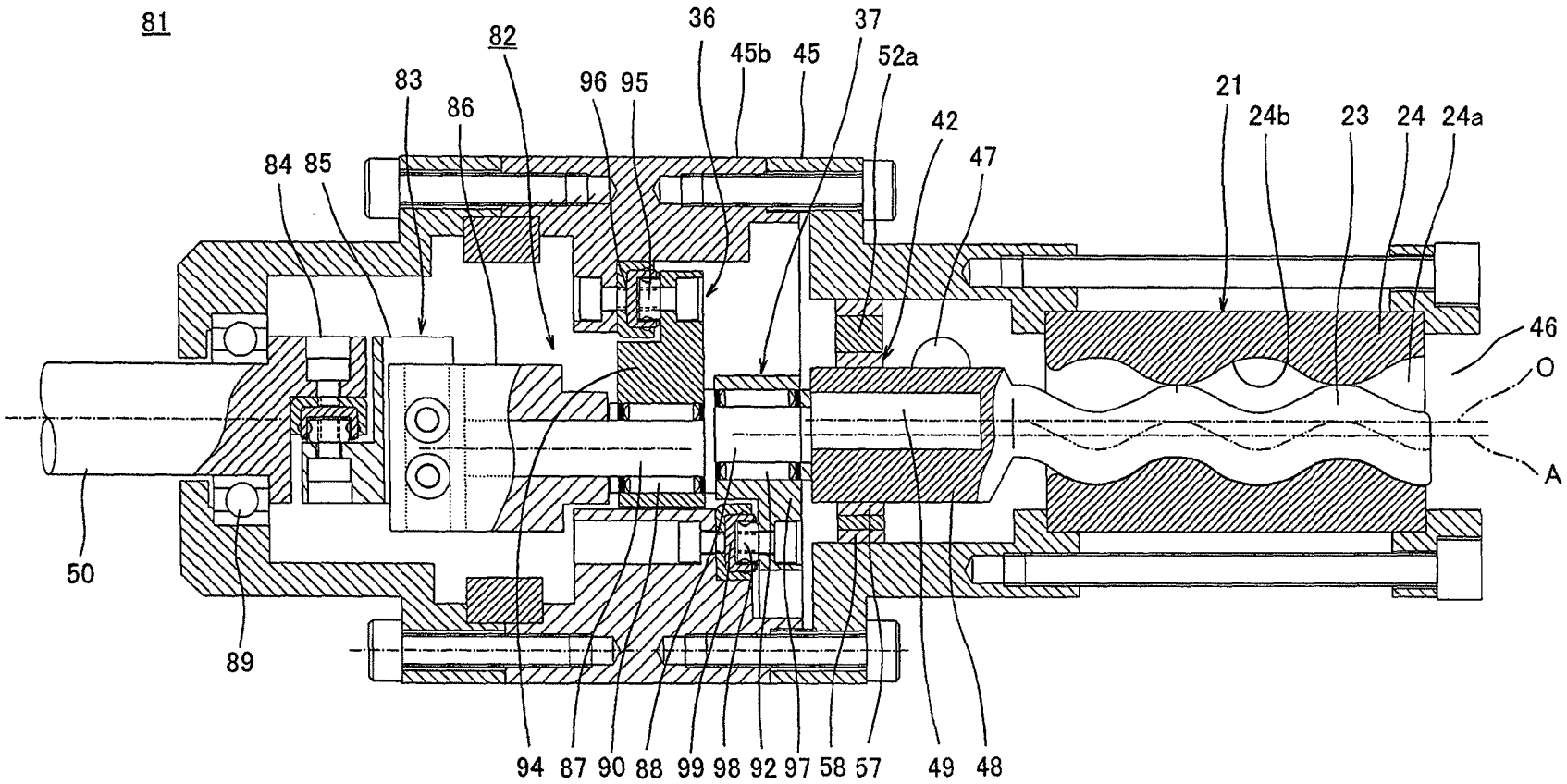
FIG. 9 is a longitudinal sectional view showing Embodiment 4 of the pump apparatus according to the present invention.

In contrast, in the link system, the movements of first and second slide mechanisms 36 and 37 shown in FIG. 9 do not exceed four times the eccentricity (revolution radius) e of the eccentric rotational movement of the rotor 23 and are in a straight direction, and the movement of the rotor drive mechanism does not become large, unlike the gear system. Therefore, in a case where the rotor diameter d1 is comparatively small, the link system can be configured to be smaller in size than the gear system.

However, since the gear system is configured to transfer the rotational power by the rotation of the gear, each joint itself has the rotational force. Therefore, the rotational power can be smoothly transferred.

In contrast, the link system is configured to transfer the rotational power by the reciprocating movement in the first and second slide mechanisms 36 and 37.

Next, Embodiment 1 of the pump apparatus including the rotor drive mechanism and the eccentric shaft sealing structure according to the present invention will be explained in reference to, for example, FIGS. 3 to 5. As shown in FIG. 3, a pump apparatus 39 can cause the rotor 23 to rotate and carry out the revolution movement (eccentric rotational movement) along the predetermined path. With this, the pump apparatus 39 can transfer and fill any fluid, such as low to high viscous fluids, with high flow rate accuracy and a long operating life.

As shown in FIG. 3, the pump apparatus 39 includes the uniaxial eccentric screw pump 21, a rotor driving portion 40, a first rotor drive mechanism 41, a first eccentric shaft sealing structure 42, and a second eccentric shaft sealing structure 43.

As shown in FIG. 3, the uniaxial eccentric screw pump 21 is a rotary volume type pump, and includes the internal screw type stator 24 and the external screw type rotor 23.

As shown in FIG. 3, the stator 24 is formed to have a substantially short cylindrical shape having the inner hole 24*a* of a double thread internal screw shape, for example. A cross-sectional shape of the inner hole 24*a* is elliptical. The stator 24 is made of engineering plastic, such as TEFLON (trademark), polyacetal, or cast nylon. Then, the stator 24 is attached to be sandwiched between a nozzle 44 and an end portion of a casing 45. The nozzle 44 has a first opening 46, and the casing 45 has a second opening 47. The first opening 46 can be used as a discharge port and a suction port, and the second opening 47 can be used as a suction port and a discharge port. The first opening 46 is communicated with a tip end opening of the inner hole 24*a* of the stator 24, and the second opening 47 is communicated with a rear end opening of the inner hole 24*a*.

As shown in FIG. 3, the rotor 23 is formed to have a single thread external screw shape, for example. A cross-sectional shape of the rotor 23 is a substantially perfect circle. A pitch of a spiral shape of the rotor 23 is set to half a pitch of the stator 24. The rotor 23 is made of a metal, such as stainless steel, and is inserted in the inner hole 24*a* of the stator 24. Moreover, a rotor shaft 48 is formed at a rear end portion of the rotor 23. The rotor shaft 48 is coupled to an output shaft portion 49 of the first rotor drive mechanism 41.

As shown in FIG. 3, the first rotor drive mechanism 41 adopts the gear system. The first rotor drive mechanism 41 transfers the rotation of an input shaft portion 50, rotated by the rotor driving portion 40, to the output shaft portion 49 coupled to the external screw type rotor 23 of the uniaxial eccentric screw pump 21. The first rotor drive mechanism 41 includes a first power transmission mechanism 41*a* configured to transfer the power from the input shaft portion 50 to the output shaft portion 49.

As shown in FIG. 3, the input shaft portion 50 is formed as a female shaft, and is rotatably provided inside the casing 45 via a bearing 51. A driving shaft 40*a* of the rotor driving portion 40 is coupled to the inside of the input shaft portion 50. A carrier 52 having a substantially short cylindrical shape is fixedly provided at an end portion of the input shaft portion 50. The carrier 52 is also rotatably provided inside the casing 45 via a bearing 53 so as to be concentric with the input shaft portion 50 at the point O. A first planetary gear (outer gear) 28 is rotatably provided at the carrier 52. The first planetary gear 28 engages the inner gear 27, and the inner gear 27 is fixedly provided inside the casing 45. As show in FIG. 4, the first planetary gear 28 engages the sun gear 30 via a second planetary gear 29. The second planetary gear 29 is rotatably provided at the carrier 52.

As shown in FIG. 3, the sun gear 30 is fixedly provided at the output shaft portion 49, and the output shaft portion 49 is rotatably provided inside the carrier 52 via bearings 54. The rotor 23 is coupled to the output shaft portion 49 via the rotor shaft 48. A central axis O of the input shaft portion 50 and a central axis O of the stator inner hole 24*a* coincide with each other, and a central axis A of the output shaft portion 49 and a central axis A of the rotor 23 coincide with each other. The central axis O and the central axis A are eccentrically provided with respect to each other by eccentricity e.

As above, the first rotor drive mechanism 41 shown in FIG. 3 is configured such that the input shaft portion 50 and the output shaft portion 49 are provided inside the pitch circle of the inner gear 27. Moreover, used as the rotor driving portion 40 is an electric motor, such as a stepping motor or a servo motor.

In accordance with the first rotor drive mechanism 41 of the pump apparatus 39 configured as shown in FIG. 3, for example, the output shaft portion 49 can be used by being coupled to the external screw type rotor 23 of the uniaxial eccentric screw pump 21. To be specific, by rotating the input shaft portion 50 in a predetermined direction, the rotation of the input shaft portion 50 is transferred to the output shaft portion 49 via the first power transmission mechanism 41*a* including the inner gear 27, the first and second planetary gears 28 and 29, and the sun gear 30. Thus, the rotor 23 can be caused to carry out the eccentric rotational movement in a predetermined direction. The eccentric rotational movement denotes that, for example, the rotor 23 rotates while carrying out the revolution movement around the central axis O (along an inner peripheral surface of the inner hole 24*a* of the stator 24) along a predetermined path at a predetermined angular speed. When the rotor 23 revolves once in the normal direction, it rotates once in the reverse direction.

By the eccentric rotational movement of the rotor 23, the space formed between the inner surface 24*b* of the stator inner hole 24*a* and the outer surface of the rotor 23 moves from the second opening 47 to the first opening 46. Therefore, a transfer fluid can be transferred in this direction.

Since the input shaft portion 50 and the output shaft portion 49 are provided inside the pitch circle of the inner gear 27 of the first power transmission mechanism 41*a*, each of the first rotor drive mechanism 41 and the pump apparatus 39 including the first rotor drive mechanism 41 can be reduced in size, weight, and cost. Therefore, the pump apparatus 39 including the first rotor drive mechanism 41 can become widespread.

Moreover, the rotor 23 can be caused to carry out the eccentric rotational movement along a certain path. Therefore, the rotor 23 and the inner hole 24*a* of the stator 24 can be formed such that when the rotor 23 carries out the eccentric rotational movement, the inner surface 24*b* of the stator inner hole 24*a* and the outer surface of the rotor 23 do not contact each other.

To be specific, the rotor 23 and the inner hole 24*a* of the stator 24 can be formed such that in the case of transferring a fluid containing fine particles for example, the fine particles are not grated between the rotor 23 and the inner surface 24*b*. With this, the transfer fluid can be transferred while maintaining the original shapes of the fine particles. Examples of the fine particles are comparatively soft powder bodies, capsule-like bodies, and saclike bodies.

Moreover, abrasion powder generated in a case where the inner surface 24*b* of the stator inner hole 24*a* and the outer surface of the rotor 23 contact each other does not get mixed in the transfer fluid, and a noise is not generated by the friction between the inner surface 24*b* of the stator inner hole 24*a* and the outer surface of the rotor 23. Moreover, the gap between the outer peripheral surface of the rotor 23 and the inner peripheral surface of the stator 24 can be set to an appropriate size depending on the property of the transfer fluid (for example, a fluid containing fine particles or slurry). With this, depending on various properties of fluids, the pump apparatus 39 can transfer and fill the fluid with high flow rate accuracy, low pulsation, and a long operating life. Further, since the rotor 23 and the stator 24 can be rotated with the rotor 23 and the stator 24 not contacting each other, the rotor can be rotated at a comparatively high speed by low torque, so that a comparatively high transfer ability can be obtained.

By forming the inner surface 24*b* of the stator inner hole 24*a* and the outer surface of the rotor 23 such that the inner surface 24*b* and the outer surface contact each other at appropriate contact pressure and rotating the rotor 23, the transfer efficiency of the transfer fluid by the pump apparatus 39 can be improved.

Next, the first eccentric shaft sealing structure 42 and the second eccentric shaft sealing structure 43 will be explained in reference to FIGS. 3 and 5. The first and second eccentric shaft sealing structures 42 and 43 prevent the transfer fluid from flowing into the first rotor drive mechanism 41 and prevent, for example, a lubricant in the first rotor drive mechanism 41 from getting mixed in the transfer fluid. Therefore, the present embodiment includes two shaft sealing structures. Any one of the first and second eccentric shaft sealing structures 42 and 43 can be omitted depending on, for example, discharge pressure of the pump 21, the type of the transfer fluid of the pump 21, or how to use the pump 21 is capable of changing the direction of rotation of the rotor 23.

As shown in FIG. 5, the first eccentric shaft sealing structure 42 seals a gap between the output shaft portion (eccentric shaft) 49 configured to carry out the eccentric rotational movement and an inner peripheral surface of the casing 45 including a large-diameter hole 45*a* through which the output shaft portion 49 is inserted so as to be able to carry out the eccentric rotational movement. The first eccentric shaft sealing structure 42 includes an annular end portion (shaft supporting portion) 52*a* of the carrier 52 which is rotatably and internally fitted in an inner peripheral surface of the large-diameter hole 45*a* of the casing 45 via the bearing 53. Then, a small-diameter hole 52*b* through which the output shaft portion 49 is rotatably inserted via the bearings 54 is formed inside the annular end portion 52*a*. A gap between a short cylindrical outer peripheral surface of the output shaft portion 49 and a short cylindrical inner peripheral surface of the small-diameter hole 52*b* is sealed by a first seal portion 57. Moreover, a gap between a short cylindrical outer peripheral surface of the annular end portion 52*a* of the carrier 52 and a short cylindrical inner peripheral surface of the large-diameter hole 45*a* is sealed by a second seal portion 58.

The outer peripheral surface of the output shaft portion 49 and the inner peripheral surface of the small-diameter hole 52*b* are concentrically provided about the point A. Then, the outer peripheral surface of the annular end portion 52*a* of the carrier 52 and the inner peripheral surface of the large-diameter hole 45*a* are concentrically provided about the point O. The eccentricity between the points A and O is e.

In accordance with the first eccentric shaft sealing structure 42 shown in FIG. 5, the output shaft portion 49 is rotated by the rotor driving portion 40 to carry out the eccentric rotational movement, so that the rotor 23 coupled to the output shaft portion 49 can be caused to carry out the same eccentric rotational movement as the output shaft portion 49. Moreover, in a case where the output shaft portion 49 carries out the eccentric rotational movement and the revolution movement, the revolution movement of the output shaft portion 49 causes the carrier (annular end portion 52*a*) 52 to rotate in the same direction. At this time, an annular gap formed between the output shaft portion 49 and the carrier 52 can be sealed by the first seal portion 57, and an annular gap formed between the carrier 52 and the casing 45 can be sealed by the second seal portion 58. Thus, the gap between the output shaft portion 49 and the inner peripheral surface of the casing 45 having the large-diameter hole 45*a* through which the output shaft portion 49 is inserted so as to be able to carry out the eccentric rotational movement can be surely and extremely easily sealed. With this, the transfer fluid can be prevented from flowing into the first rotor drive mechanism 41 and, for example, the lubricant in the first rotor drive mechanism 41 can be prevented from flowing into the stator 24.

As shown in FIG. 5, the second eccentric shaft sealing structure 43 seals a gap between the rotor shaft (eccentric shaft coupled to the output shaft portion 49) 48 configured to carry out the eccentric rotational movement and the casing 45 having the large-diameter hole 45*a* through which the rotor shaft 48 is inserted so as to be able to carry out the eccentric rotational movement. The second eccentric shaft sealing structure 43 includes a circular coupling portion 59 having a small-diameter hole 59*a* through which the rotor shaft 48 is rotatably inserted. A gap formed between an outer peripheral surface of the rotor shaft 48 and an inner peripheral surface of the circular coupling portion 59 is sealed by a third seal portion 60. To be specific, as shown in FIG. 5, the third seal portion 60 is attached firmly to the outer peripheral surface of the rotor shaft 48, and slidably contacts an end surface of the circular coupling portion 59, so that this contact portion is sealed.

A gap formed between an outer peripheral surface of the circular coupling portion 59 and the inner peripheral surface of the large-diameter hole 45*a* is sealed by a diaphragm 61. The rotor shaft 48 is rotatably attached to the circular coupling portion 59 via a bearing 62.

In accordance with the second eccentric shaft sealing structure 43, in a case where the rotor shaft (output shaft portion 49) 48 carries out the eccentric rotational movement and the revolution movement, the diaphragm 61 freely deforms with respect to the revolution movement of the rotor shaft 48. Therefore, the gap between the rotor shaft 48 and the inner peripheral surface of the casing 45 having the large-diameter hole 45*a* through which the rotor shaft 48 is inserted so as to be able to carry out the eccentric rotational movement can be surely sealed by an extremely simple configuration.

Then, the annular gap formed between the outer peripheral surface of the rotor shaft 48 and the inner peripheral surface of the circular coupling portion 59 can be sealed by the third seal portion 60 both when the rotor shaft 48 rotates and when the rotor shaft 48 does not rotate. With this, the transfer fluid can be prevented from flowing into the first rotor drive mechanism 41 and, for example, the lubricant in the first rotor drive mechanism 41 can be prevented from flowing into the stator 24.

Next, Embodiment 2 of the pump apparatus including the rotor drive mechanism and the eccentric shaft sealing structure according to the present invention will be explained in reference to, for example, FIG. 6. A pump apparatus 64 of Embodiment 2 shown in FIG. 6 and the pump apparatus 39 of Embodiment 1 shown in FIG. 3 are different from each other in that, in Embodiment 1 shown in FIG. 3, the rotor shaft 48 is coupled to the rotor 23 via an intermediate shaft 65, and each of the rotor shaft 48, the intermediate shaft 65, and the rotor 23 is made of a metal which is less likely to deform, and in Embodiment 2 shown in FIG. 6, the rotor shaft 48 is coupled to the rotor 23 via a flexible rod 66, and each of the rotor shaft 48, the flexible rod 66, and the rotor 23 is made of synthetic resin, for example.

The flexible rod 66 is formed to be deformable such that the quality of the transfer fluid transferred by the pump apparatus 64 is not deteriorated by the contact pressure between the rotor 23 and the inner surface 24*b* of the stator inner hole 24*a*. Other than the above, the pump apparatus 64 of Embodiment 2 is the same as the pump apparatus 39 of Embodiment 1, so that the same reference numbers are used for the same components, and a repetition of the same explanation is avoided.

Figure 6:
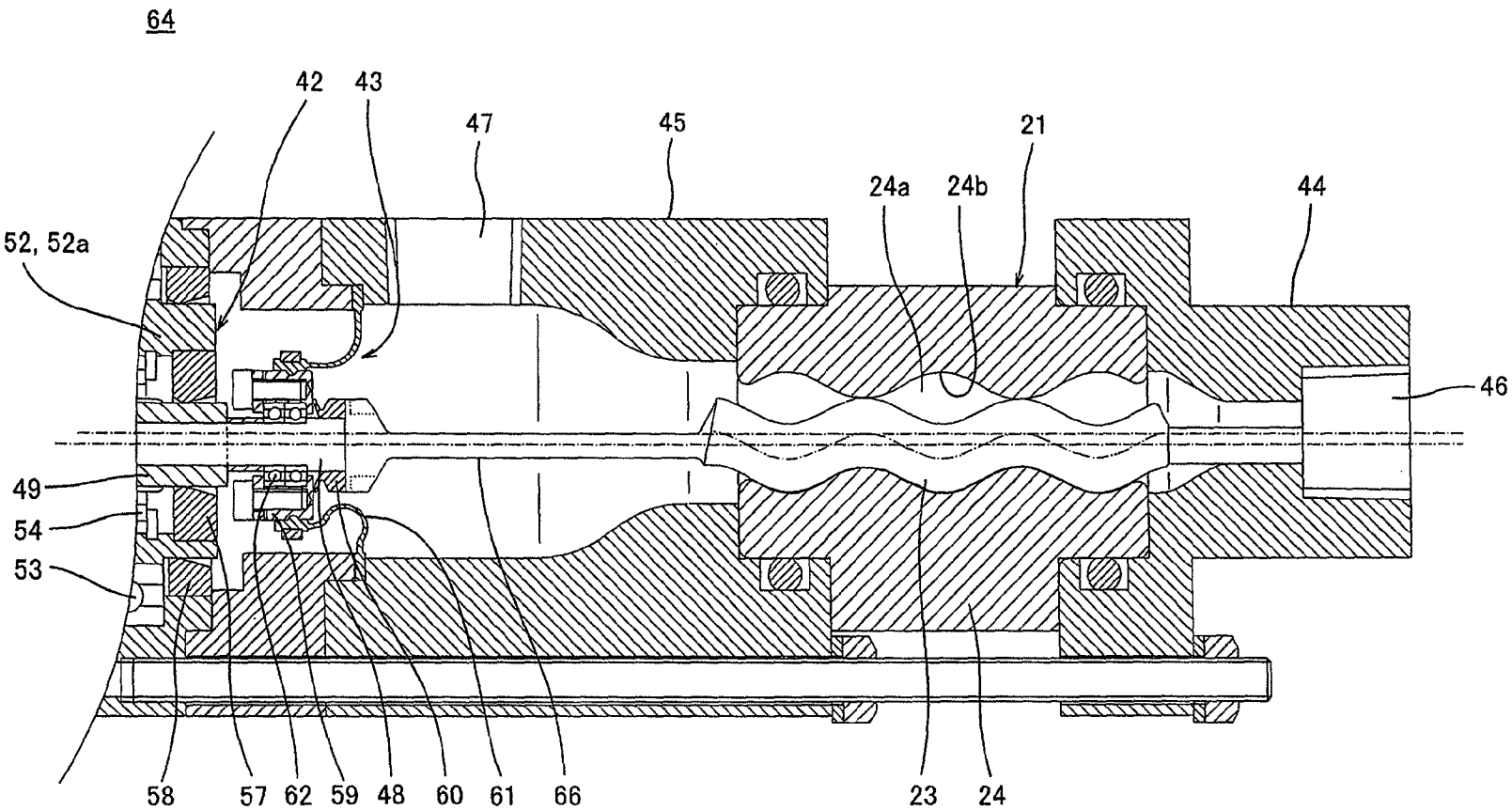
FIG. 6 is a longitudinal sectional view showing Embodiment 2 of the pump apparatus according to the present invention.

In accordance with the pump apparatus 64 of Embodiment 2 shown in FIG. 6, for example, in a case where a force of pressing the rotor 23 to the inner surface 24*b* of the inner hole 24*a* of the stator 24 is generated during the operation of the pump apparatus 64, the flexible rod 66 and the rotor 23 can deform, such that the quality of the transfer fluid transferred by the pump apparatus 64 is not deteriorated by the contact pressure between the rotor 23 and the inner surface 24*b* of the stator inner hole 24*a*.

Moreover, the flexible rod 66 can be formed to be deformable such that, for example, in a case where the transfer fluid is a liquid containing fine particles, and the force of pressing the rotor 23 to the inner surface 24*b* of the inner hole 24*a* of the stator 24 is generated, the flexible rod 66 and the rotor 23 deform to prevent the fine particles from being damaged.

As above, in accordance with the pump apparatus 64 shown in FIG. 6, since the flexible rod 66 and the rotor 23 are made of synthetic resin, the liquid containing comparatively soft fine particles can be transferred while preventing the fine particles from being grated. Examples of the fine particles are powder bodies, capsule-like bodies, and saclike bodies. Other than the above, the pump apparatus 64 of Embodiment 2 shown in FIG. 6 functions in the same manner as the pump apparatus 39 of Embodiment 1 shown in FIG. 3, so that an explanation thereof is omitted.

Figure 8:
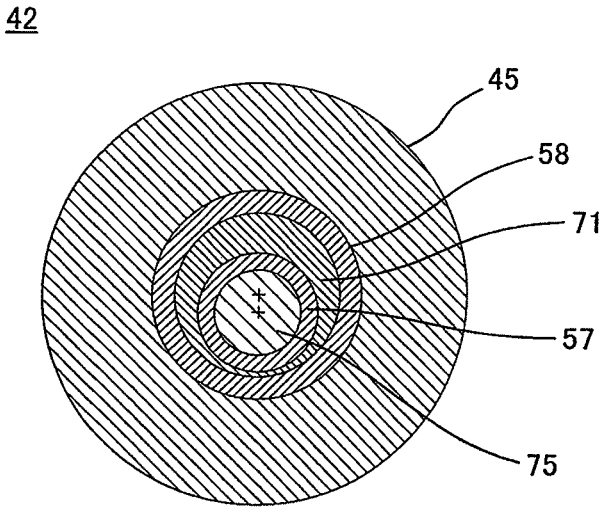
FIG. 8 is an F-F cross-sectional view of the pump apparatus according to Embodiment 3.

Next, Embodiment 3 of the pump apparatus including the rotor drive mechanism according to the present invention will be explained in reference to, for example, FIGS. 7 and 8. A pump apparatus 68 of Embodiment 3 shown in FIG. 7 and the pump apparatus 39 of Embodiment 1 shown in FIG. 3 are different from each other in that, the first rotor drive mechanism 41 and a second rotor drive mechanism 69 are different from each other, and the second eccentric shaft sealing structure 43 is not provided in Embodiment 3 shown in FIG. 7.

Other than the above, the pump apparatus 68 of Embodiment 3 is the same as the pump apparatus 39 of Embodiment 1, so that the same reference numbers are used for the same components, and a repetition of the same explanation is avoided.

The second rotor drive mechanism 69 shown in FIG. 7 transfers the rotation of the input shaft portion 50, rotated by the rotor driving portion 40, to the output shaft portion 49 coupled to the external screw type rotor 23 of the uniaxial eccentric screw pump 21. The second rotor drive mechanism 69 includes a second power transmission mechanism 69*a* configured to transfer the power from the input shaft portion 50 to the output shaft portion 49.

As shown in FIG. 7, the input shaft portion 50 is rotatably provided inside the casing 45 via a bearing 70. The driving shaft 40*a* of the rotor driving portion 40 is coupled to the input shaft portion 50. A carrier 71 is fixedly provided at an end portion of the input shaft portion 50. The carrier 71 is also rotatably provided inside the casing 45 via a bearing 72 so as to be concentric with the input shaft portion 50 at the point O. A first planetary gear (outer gear) 33 is rotatably provided at the carrier 71 via a first shaft 73. The first planetary gear 33 engages the inner gear 32, and the inner gear 32 is fixedly provided inside the casing 45. Moreover, the eccentric joint 34, such as the Oldham coupling, is provided at an end portion of the first shaft 73 to which the first planetary gear 33 is attached. The first shaft 73 is coupled to the output shaft portion 49 via the eccentric joint 34.

As shown in FIG. 7, the output shaft portion 49 is rotatably provided inside the carrier 71 via a bearing 74. The rotor 23 is coupled to the output shaft portion 49 via a rotor shaft 75. The central axis O of the input shaft portion 50 and the central axis O of the stator inner hole 24*a* coincide with each other, and the central axis A of the output shaft portion 49 and the central axis A of the rotor 23 coincide with each other. The central axis O and the central axis A are eccentrically provided with respect to each other by e. FIG. 8 is an F-F cross sectional view showing the first eccentric shaft sealing structure 42.

As shown in FIG. 7, the eccentric joint 34 is the Oldham coupling, for example, and includes a driving portion 76, an intermediate portion 77, and a driven portion 78. A pair of engagement grooves 76*a* and 77*a* are respectively formed on a side surface of the driving portion 76 and a side surface of the intermediate portion 77, which surfaces are opposed to each other, so as to be in parallel with each other. A plurality of steel balls 79 are stored in the pair of engagement grooves 76*a* and 77*a*. With this, the intermediate portion 77 is movable with respect to the driving portion 76 in a direction in which the groove extends. Moreover, the driven portion 78 and the intermediate portion 77 are also provided with engagement grooves 77*b* and 78*a* and a plurality of steel balls 79, which are equivalent to the pair of engagement groove 76*a* and 77*a* and the plurality of steel balls 79 of the driving portion 76 and the intermediate portion 77.

The engagement grooves 77*a* and 77*b* respectively formed on left and right side surfaces of the intermediate portion 77 extend substantially perpendicular to each other. The driving portion 76 is coupled to the first shaft 73 to which the first planetary gear 33 is rotatably attached, and the output shaft portion 49 is coupled to the driven portion 78.

In accordance with the second rotor drive mechanism 69 of the pump apparatus 68 configured as shown in, for example, FIG. 7, since the second power transmission mechanism 69*a* includes the eccentric joint 34, the number of planetary gears used in the second power transmission mechanism 69*a* can be reduced, and the sun gear 30 can be omitted. With this, the noise generated by the engagement of the gears can be reduced. On this account, a use environment can be improved.

Other than the above, the pump apparatus 68 of Embodiment 3 shown in FIG. 7 is the same as the pump apparatus 39 of Embodiment 1 shown in FIG. 3, so the same reference numbers are used for the same components, and a repetition of the same explanation is avoided.

Next, Embodiment 4 of the pump apparatus including the rotor drive mechanism according to the present invention will be explained in reference to, for example, FIGS. 9 to 11. A pump apparatus 81 of Embodiment 4 shown in FIG. 9 and the pump apparatus 39 of Embodiment 1 shown in FIG. 3 are different from each other in that the first rotor drive mechanism 41 and a third rotor drive mechanism 82 are different from each other, and the second eccentric shaft sealing structure 43 is not provided in Embodiment 4, as shown in FIG. 9. Other than the above, the pump apparatus 81 of Embodiment 4 is the same as the pump apparatus 39 of Embodiment 1, so that the same reference numbers are used for the same components, and a repetition of the same explanation is avoided.

The third rotor drive mechanism 82 shown in FIG. 9 transfers the rotation of the input shaft portion 50, rotated by the rotor driving portion 40, to the output shaft portion 49 coupled to the external screw type rotor 23 of the uniaxial eccentric screw pump 21.

The input shaft portion 50 is coupled to the output shaft portion 49 via an eccentric joint 83, a first shaft portion 87, and a second shaft portion 88. As shown in FIG. 9, the input shaft portion 50 is rotatably provided inside the casing 45 via a bearing 89. The driving shaft 40*a* of the rotor driving portion 40 is coupled to the input shaft portion 50.

As shown in FIG. 9, the eccentric joint 83 is the Oldham coupling, for example, and includes a driving portion 84, an intermediate portion 85, and a driven portion 86. The driving portion 84 is coupled to the input shaft portion 50, and the driven portion 86 is coupled to the first shaft portion 87. The eccentric joint 83 is conventionally known, and can transfer the rotation of the input shaft portion 50 to the rotor 23 via the first shaft portion 87 (output shaft portion 49) eccentrically provided with respect to the eccentric joint 83.

As shown in FIG. 9 and FIG. 11(*c*), the first shaft portion 87, the second shaft portion 88, and the output shaft portion 49 are coupled to one another in this order so as to be eccentrically provided with respect to one another by predetermined eccentricities. Then, the first shaft portion 87 is rotatably supported by the first slide mechanism 36 via a bearing 90, and is movable in a first straight direction 91 (see FIG. 10(*a*)), substantially perpendicular to a center axis of the first shaft portion 87. The second shaft portion 88 is rotatably supported by the second slide mechanism 37 via a bearing 92, and is movable in a second straight direction 93 (see FIG. 10(*a*)), substantially perpendicular to a center axis of the second shaft portion 88.

The first straight direction 91 in which the first shaft portion 87 is movable and the second straight direction 93 in which the second shaft portion 88 is movable are arranged to form a predetermined three-dimensional cross angle (30 degrees, for example) corresponding to the eccentricity between the first shaft portion 87 and the second shaft portion 88.

As shown in FIG. 9, the first slide mechanism 36 includes a first shaft supporting portion 94 configured to rotatably support the first shaft portion 87, a first slide portion 95 coupled to the first shaft supporting portion 94, and a first guiding portion 96 configured to guide the first slide portion 95 in the first straight direction 91.

As shown in FIG. 9, the second slide mechanism 37 includes a second shaft supporting portion 97 configured to rotatably support the second shaft portion 88, a second slide portion 98 coupled to the second shaft supporting portion 97, and a second guiding portion 99 configured to guide the second slide portion 98 in the second straight direction 93.

To be specific, the first shaft portion 87 is link-coupled to the first guiding portion 96 via the first shaft supporting portion 94 and first slide portion 95 of the first slide mechanism 36, and the second shaft portion 88 is link-coupled to the second guiding portion 99 via the second shaft supporting portion 97 and second slide portion 98 of the second slide mechanism 37.

FIG. 10(*b*) is a diagram showing a positional relation among a central axis $B_{11}$ of the first shaft portion 87, a central axis $B_{21}$ of the second shaft portion 88, and a central axis S of the output shaft portion 49. An angle P is 60 degrees, and an angle Q is 30 degrees. FIGS. 11(*a*) and 11(*b*) are diagrams showing a slide attaching member 45*b* to which the first and second slide mechanisms 36 and 37 are attached. FIG. 11(*a*) is a longitudinal sectional view, and FIG. 11(*b*) is a front view. FIG. 11(*c*) is a front view showing the output shaft portion 49. FIGS. 11(*d*) and 11(*e*) are diagrams showing an exemplary first shaft supporting portion 94, or an exemplary second shaft supporting portion 97. FIG. 11(*d*) is a front view, and FIG. 11(*e*) is a sectional view.

In accordance with the third rotor drive mechanism 82 shown in FIG. 9, as with the first rotor drive mechanism 41 of Embodiment 1 shown in FIG. 3, the output shaft portion 49 can be used by being coupled to the external screw type rotor 23 of the uniaxial eccentric screw pump 21. Then, by rotating the input shaft portion 50 in a predetermined direction, the rotation of the input shaft portion 50 is transferred to the output shaft portion 49 via the eccentric joint 83 and the first and second shaft portions 87 and 88. Thus, the rotor 23, eccentrically coupled to the output shaft portion 49, can be caused to carry out the eccentric rotational movement as with the first rotor drive mechanism 41.

The reason why the rotor 23 carries out the eccentric rotational movement along the predetermined path is because the first shaft portion 87 and the second shaft portion 88 are eccentrically coupled to each other by a predetermined eccentricity, the first and second shaft portions 87 and 88 are rotatably supported by the first and second slide mechanisms 36 and 37, respectively, the first shaft portion 87 is movable in the first straight direction 91 substantially perpendicular to the center axis of the first shaft portion 87, the second shaft portion 88 is movable in the second straight direction 93 substantially perpendicular to the center axis of the second shaft portion 88, and the first straight direction 91 in which the first shaft portion 87 is movable and the second straight direction 93 in which the second shaft portion 88 is movable are arranged to form a predetermined three-dimensional cross angle corresponding to the eccentricity between the first shaft portion 87 and the second shaft portion 88.

Moreover, in accordance with the third rotor drive mechanism 82 shown in FIG. 9, as with the first rotor drive mechanism 41 shown in FIG. 3, the first and second planetary gears 28 and 29, the inner gear 27, and the sun gear 30 are not required. With this, the volume of the third rotor drive mechanism 82 can be comparatively reduced. This is because in the case of using the planetary gears 28, 29, the inner gear 27, and the sun gear 30, these gears rotate around the input shaft portion 50 and the output shaft portion 49, so that this rotation range defines the size of the first rotor drive mechanism 41. Moreover, since the gears are not required, the noise generated by the engagement of the gears can be eliminated.

Further, in accordance with the third rotor drive mechanism 82 shown in FIG. 9, as with the first rotor drive mechanism 41 shown in FIG. 3, the rotor 23 can be caused to carry out the eccentric rotational movement. The eccentric rotational movement denotes that the rotor 23 rotates while carrying out the revolution movement around the central axis O (along the inner peripheral surface of the inner hole 24*a* of the stator 24) at a predetermined angular speed. When the rotor 23 revolves once in the normal direction, it rotates once in the reverse direction. By the eccentric rotational movement of the rotor 23, the space formed between the inner surface 24*b* of the stator inner hole 24*a* and the outer surface of the rotor 23 moves from the second opening 47 to the first opening 46. Therefore, the transfer fluid can be transferred in this direction.

Moreover, as with a case where the rotor 23 is driven by the first rotor drive mechanism 41 of Embodiment 1 shown in FIG. 3, the rotor 23 carries out the eccentric rotational movement along a certain path. Therefore, the rotor 23 and the inner hole 24*a* of the stator 24 can be formed such that when the rotor 23 carries out the eccentric rotational movement, the inner surface 24*b* of the stator inner hole 24*a* and the outer surface of the rotor 23 do not contact each other, or the inner surface 24*b* of the stator inner hole 24*a* and the outer surface of the rotor 23 contact each other at appropriate pressure.

The first eccentric shaft sealing structure 42 included in the pump apparatus 81 of Embodiment 4 shown in FIG. 9 includes the annular end portion 52*a* as a circular plate member. The annular end portion (circular plate member) 52*a* rotates by the eccentric rotational movement of the rotor shaft (output shaft 49) 48 in the same direction as the eccentric rotational movement of the rotor shaft 48. Other than the above, the pump apparatus 81 of Embodiment 4 shown in FIG. 9 functions in the same manner as the pump apparatus 39 of Embodiment 1 shown in FIG. 3, so an explanation thereof is omitted.

Next, Embodiment 5 of the pump apparatus including the rotor drive mechanism according to the present invention will be explained in reference to, for example, FIG. 12. A pump apparatus 101 of Embodiment 5 shown in FIG. 12 and the pump apparatus 39 of Embodiment 1 shown in FIG. 3 are different from each other in that: the first rotor drive mechanism 41 is provided in Embodiment 1 shown in FIG. 3; instead of the first rotor drive mechanism 41, a fourth rotor drive mechanism 102 is provided in Embodiment 5 shown in FIG. 12; the first and second eccentric shaft sealing structures 42 and 43 are provided in Embodiment 1 shown in FIG. 3; and instead of the first and second eccentric shaft sealing structures 42 and 43, third and fourth eccentric shaft sealing structures 103 and 104 are provided in Embodiment 5 shown in FIG. 12. Other than the above, the pump apparatus 101 of Embodiment 5 is the same as the pump apparatus 39 of Embodiment 1, so that the same reference numbers are used for the same components, and a repetition of the same explanation is avoided.

The fourth rotor drive mechanism 102 shown in FIG. 12 adopts a screw type bearing system, and transfers the rotation of the input shaft portion 50, rotated by the rotor driving portion 40, to an output shaft portion 105 coupled to the external screw type rotor 23 of the uniaxial eccentric screw pump 21. The fourth rotor drive mechanism 102 includes an eccentric joint 106, a first bearing structure 109, and a second bearing structure 110.

As shown in FIG. 12, the input shaft portion 50 is coupled to the output shaft portion 105 via the eccentric joint 106 and the first bearing structure 109. The driving shaft 40*a* of the rotor driving portion 40 is coupled to the input shaft portion 50.

As shown in FIG. 12, the eccentric joint 106 is the Oldham coupling, for example, includes the driving portion 84, the intermediate portion 85, and the driven portion 86, and can transfer the rotation of the driving portion 84 to the driven portion 86 eccentrically provided with respect to the driving portion 84. The driving portion 84 is coupled to the input shaft portion 50, and the driven portion 86 is coupled to the output shaft portion 105. The eccentric joint 106 is equivalent to, for example, the eccentric joint 83 shown in FIGS. 7 and 9.

The first bearing structure 109 includes the output shaft portion 105 and an internal screw bearing portion 107. The output shaft portion 105 is substantially the same in shape and size as the external screw type rotor 23 of the uniaxial eccentric screw pump 21, and the internal screw bearing portion 107 has an inner hole 107*a* which is substantially the same in shape and size as the internal screw type inner hole 24*a* of the stator 24 to which the external screw type rotor 23 is rotatably attached. Here, the gap in the fit between the output shaft portion 105 and the internal screw bearing portion 107 is narrower than the gap in the fit between the external screw type rotor 23 and the internal screw type inner hole 24*a* of the stator 24, or the fit between the output shaft portion 105 and the internal screw bearing portion 107 is tighter than the fit between the external screw type rotor 23 and the internal screw type inner hole 24*a* of the stator 24. A portion of the output shaft portion 105 which portion is stored in the internal screw bearing portion 107 is shorter than a portion of the external screw type rotor 23 which portion is stored in the stator 24. Then, the internal screw bearing portion 107 is attached to an inner surface of a first casing 108.

As shown in FIG. 12, the second bearing structure 110 is equivalent to the first bearing structure 109, so that the same reference numbers are used for the same components, and a repetition of the same detailed explanation is avoided. The output shaft portion 105 of the second bearing structure 110 is coupled to a tip end portion of the external screw type rotor 23. The internal screw bearing portion 107 is attached to inner surfaces of second and third casings 111 and 112.

As shown in FIG. 12, the third eccentric shaft sealing structure 103 seals a gap between a second space portion 113 communicated with the second opening 47 and the inner hole 107*a* of the first bearing structure 109 such that a gas or a liquid does not flow through the gap. The third eccentric shaft sealing structure 103 includes a circular seal seat portion 115 including a small-diameter hole through which a rotor shaft 114 is rotatably inserted. A gap formed between an outer peripheral surface of the rotor shaft 114 and an inner peripheral surface of the circular seal seat portion 115 is sealed by fourth and fifth seal portions 116 and 117. The rotor shaft 114 is formed between the output shaft portion 105 and the rotor 23.

The fourth and fifth seal portions 116 and 117 are attached to a circular seal attaching portion 118, and the circular seal attaching portion 118 is fixedly attached to the rotor shaft 114. The fourth seal portion 116 seals a gap between an outer peripheral surface of the circular seal attaching portion 118 and a seat surface of the circular seal seat portion 115. The fifth seal portion 117 seals a gap between the outer peripheral surface of the rotor shaft 114 and an inner peripheral surface of the circular seal attaching portion 118.

As shown in FIG. 12, the fourth eccentric shaft sealing structure 104 seals a gap between a first space portion 119 communicated with the first opening 46 and the inner hole 107*a* of the second bearing structure 110 such that a gas or a liquid does not flow through the gap. The fourth eccentric shaft sealing structure 104 is equivalent to the third eccentric shaft sealing structure 103, so that the same reference numbers are used for the same components, and a repetition of the same explanation is avoided. Note that the output shaft portion 105 included in the fourth eccentric shaft sealing structure 104 is coupled to a tip end side portion of the rotor 23 via the rotor shaft 114.

Reference numbers 120 and 121 shown in FIG. 12 denote pressure bypass ports. The pressure bypass port 120 suppresses the pressure variation in spaces to which left and right portions of the output shaft portion 105 of the first bearing structure 109 are exposed by the rotation of the output shaft portion 105 of the first bearing structure 109, and the pressure bypass port 121 suppresses the pressure variation in spaces to which left and right portions of the output shaft portion 105 of the second bearing structure 110 are exposed by the rotation of the output shaft portion 105 of the second bearing structure 110. Then, an opening 122 of the first casing 108 and an opening 123 of the third casing 112 further suppress the pressure variation. The inner hole 107*a* of the internal screw bearing portion 107 of the first bearing structure 109 is communicated with an outer space by the opening 122, and the inner hole 107*a* of the internal screw bearing portion 107 of the second bearing structure 110 is communicated with the outer space by the opening 123.

In accordance with the fourth rotor drive mechanism 102 shown in FIG. 12, as with the first rotor drive mechanism 41 of Embodiment 1 shown in FIG. 3, the output shaft portion 105 can be used by being coupled to the external screw type rotor 23 of the uniaxial eccentric screw pump 21. By rotating the input shaft portion 50 in a predetermined direction, the rotation of the input shaft portion 50 is transferred via the eccentric joint 106 to the output shaft portion 105 coupled to the eccentric joint 106. Since the output shaft portion 105 is formed as an external screw type, and is attached to the internal screw bearing portion 107, the output shaft portion 105 can carry out the eccentric rotational movement. Then, since the external screw type rotor 23 coupled to the output shaft portion 105 is also attached to the internal screw type inner hole 24*a* of the stator 24, it can carry out the eccentric rotational movement as with the output shaft portion 105. Here, the gap in the fit between the output shaft portion 105 and the internal screw bearing portion 107 is narrower than the gap in the fit between the external screw type rotor 23 and the internal screw type inner hole 24*a* of the stator 24, or the fit between the output shaft portion 105 and the internal screw bearing portion 107 is tighter than the fit between the external screw type rotor 23 and the internal screw type inner hole 24*a* of the stator 24, and the fit between the output shaft portion 105 and the internal screw bearing portion 107 is appropriately set. Therefore, the external screw type rotor 23 can be caused to carry out the eccentric rotational movement along the predetermined path. In addition, since the fourth rotor drive mechanism 102 does not use the gear mechanism or the link mechanism, the external screw type rotor 23 can be caused to carry out the eccentric rotational movement along the predetermined path with comparatively high accuracy by a simple configuration. Other than the above, the pump apparatus 101 of Embodiment 5 shown in FIG. 12 functions in the same manner as the pump apparatus 39 of Embodiment 1 shown in FIG. 3, so that an explanation thereof is omitted.

Moreover, as shown in FIG. 12, in accordance with the fourth rotor drive mechanism 102, since the first bearing structure 109 and the second bearing structure 110 are respectively provided at both end portions of the external screw type rotor 23, the amount of deflection of the external screw type rotor 23 can be reduced. With this, positioning accuracy for causing the external screw type rotor 23 to carry out the eccentric rotational movement along the predetermined path can be improved.

In the pump apparatus 101 of Embodiment 5 shown in FIG. 12, the first bearing structure 109 and the second bearing structure 110 are respectively provided at left and right end portions of the external screw type rotor 23. However, the second bearing structure 110 may be omitted.

Next, Embodiment 6 of the pump apparatus including the rotor drive mechanism according to the present invention will be explained in reference to, for example, FIG. 13. A pump apparatus 125 of Embodiment 6 shown in FIG. 13 and the pump apparatus 39 of Embodiment 1 shown in FIG. 3 are different from each other in that: the first rotor drive mechanism 41 is provided in Embodiment 1 shown in FIG. 3; instead of the first rotor drive mechanism 41, a fifth drive mechanism 126 is provided in Embodiment 6 shown in FIG. 13; the shaft sealing structures 42 and 43 of the first and second eccentric shaft 141 are provided in Embodiment 1 shown in FIG. 3; instead of the shaft sealing structures 42 and 43, a fifth eccentric shaft sealing structure 127 is provided in Embodiment 6 shown in FIG. 13; and a cooled seal portion 128 and a cooling port 129 are provided in Embodiment 6 shown in FIG. 13. Other than the above, the pump apparatus 125 of Embodiment 6 is the same as the pump apparatus 39 of Embodiment 1, so that the same reference numbers are used for the same components, and a repetition of the same explanation is avoided.

The fifth drive mechanism 126 shown in FIG. 12 transfers the rotation of an input shaft portion 131, rotated by a driving portion (equivalent to the rotor driving portion 40) 130, to a rotor revolution drive mechanism 132 and a stator rotation drive mechanism 133 to cause the rotor 23 to carry out the revolution movement and cause the stator 24 to rotate. An engagement mechanism 134 is provided to prevent the rotor 23 from rotating.

As shown in FIG. 13, the input shaft portion 131 is rotatably provided at a casing 136 via bearings 135, and one end portion thereof is coupled to a driving shaft 130*a* of the driving portion 130.

As shown in FIG. 13, the rotor revolution drive mechanism 132 includes a first outer gear 137 fixedly provided at a left end portion of the input shaft portion 131. The first outer gear 137 engages the second outer gear 138, and the second outer gear 138 is fixedly provided at an outer peripheral portion of a shaft supporting portion 139 having a substantially short cylindrical shape. The shaft supporting portion 139 is rotatably provided at an inner peripheral surface of the casing 136 via bearings 140. A small-diameter hole is formed inside the shaft supporting portion 139. The eccentric shaft 141 is inserted through the small-diameter hole. The eccentric shaft 141 is rotatably provided at an inner peripheral surface of the small-diameter hole via bearings 142. The rotor 23 is coupled to a right end portion of the eccentric shaft 141 via a rotor shaft 143, and the engagement mechanism 134 is coupled to a left end portion of the eccentric shaft 141.

In accordance with the rotor revolution drive mechanism 132 shown in FIG. 13, by driving the driving portion 130 to rotate the input shaft portion 131 in a predetermined direction, the rotation of the input shaft portion 131 is transferred to the first outer gear 137, the second outer gear 138, and the shaft supporting portion 139. With this, the eccentric shaft 141 and the rotor 23 can be caused to carry out the revolution movement (eccentric rotational movement). The center of the revolution movement coincides with the central axis O of the internal screw type inner hole 24*a* of the stator 24. The eccentricity between the central axis O of the internal screw type inner hole 24*a* and the central axis A of each of the rotor 23 and the eccentric shaft 141 is e. The engagement mechanism 134 locks to prevent the rotor 23 from rotating when the rotor 23 carries out the revolution movement.

As shown in FIG. 13, the engagement mechanism 134 has the same configuration as the Oldham coupling, for example, and includes a fixing portion 144, an intermediate portion 145, and a driven portion 146. The fixing portion 144 is fixedly provided at the casing 136, and the driven portion 146 is fixedly attached to the eccentric shaft 141. A through hole 147 is formed at the fixing portion 144, the intermediate portion 145, and the driven portion 146. The eccentric shaft 141 is inserted through the through hole 147 so as to be able to carry out the revolution movement.

To be specific, the driven portion 146 of the engagement mechanism 134 is coupled to the intermediate portion 145 so as to be movable in a direction relatively vertical to the intermediate portion 145, and the intermediate portion 145 is coupled to the fixing portion 144 so as to be movable in a direction relatively horizontal to the fixing portion 144. With this, when the eccentric shaft 141 carries out the revolution movement about the central axis O, the engagement mechanism 134 can cause the driven portion 146 to follow the eccentric shaft 141 to carry out the revolution movement and can lock to prevent the eccentric shaft 141 from rotating about the central axis A.

As shown in FIG. 13, the stator rotation drive mechanism 133 includes a third outer gear 148 fixedly provided at a right end portion of the input shaft portion 131. The third outer gear 148 engages a fourth outer gear 149, and the fourth outer gear 149 is fixedly provided at an outer peripheral portion of the stator 24 having a substantially short cylindrical shape. The stator 24 is rotatably provided at the inner peripheral surface of the casing 136 via a bearing 150. The internal screw type inner hole 24*a* is formed inside the stator 24. The rotor 23 is attached to the inner hole 24*a*. The rotor 23 is coupled to the eccentric shaft 141 via the rotor shaft 143.

In accordance with the stator rotation drive mechanism 133 shown in FIG. 13, by driving the driving portion 130 to rotate the input shaft portion 131 in a predetermined direction, the rotation of the input shaft portion 131 is transferred to the third outer gear 148, the fourth outer gear 149, and the stator 24. With this, the stator 24 can be caused to rotate in a predetermined direction. The center of rotation of the stator 24 coincides with the central axis O of the internal screw type inner hole 24*a* of the stator 24. The first to fourth outer gears (137, 138, 148, 149) are formed such that the stator 24 rotates at a rotating speed that is half the rotating speed of the rotor 23, in the same direction as the rotor 23.

In accordance with the fifth drive mechanism 126 of the pump apparatus 125 configured as shown in, for example, FIG. 13, by driving the driving portion 130 to rotate the input shaft portion 131 in a predetermined direction, the rotor 23 can be caused to carry out the revolution movement along the inner peripheral surface of the inner hole 24*a* of the stator 24 at a predetermined angular speed while preventing the rotor 23 from rotating, and the stator 24 can be caused to rotate in a direction of revolution of the rotor 23. As a result, the rotor 23 can be caused to carry out the eccentric rotational movement. The eccentric rotational movement denotes that when the rotor 23 revolves once in the normal direction around the central axis O (along the inner peripheral surface of the inner hole 24*a* of the stator 24) at a predetermined angular speed, the rotor 23 rotates once in a relatively reverse direction with respect to the stator 24.

By the eccentric rotational movement of the rotor 23, the space formed between the inner surface 24*b* of the stator inner hole 24*a* and the outer surface of the rotor 23 moves in a predetermined direction along the central axis of the rotor 23, so that the transfer fluid can be transferred in this direction. In the present embodiment, for example, the transfer fluid is suctioned from the second opening 47, flows through the stator inner hole 24*a* to a space 151 formed on a right end portion side of the rotor 23, further flows from the space 151 through a passage 152 formed inside the rotor 23 and the eccentric shaft 141, and is discharged from the first opening 46 formed at the left end portion of the eccentric shaft 141. By inversely rotating the rotor 23, the transfer fluid can be suctioned from the first opening 46 and discharged from the second opening 47.

Moreover, since the rotor 23 does not rotate, distortion thereof is less likely to occur. With this, it is possible to surely prevent the inner surface 24*b* of the internal screw type inner hole 24*a* of the stator 24 to which the external screw type rotor 23 is attached and the outer surface of the rotor 23 from contacting each other due to the distortion of the rotor 23. Therefore, the transfer fluid can be transferred by the rotation while preventing these surfaces from contacting each other. Since the distortion is less likely to occur, the gap between these surfaces can be set with high accuracy.

Therefore, in the case of transferring the fluid containing the fine particles, for example, the fluid can be transferred while maintaining the original shapes of the fine particles such that the fine particles are not grated between the rotor 23 and the inner surface 24*b*. In addition, since the contact pressure between the rotor 23 and the inner surface 24*b* can be set within a predetermined range with high accuracy, the abrasion of the rotor 23 and the stator 24 can be suppressed, and the power for rotating the rotor 23 can be reduced.

Further, as shown in FIG. 13, since each of the central axis of the stator inner hole 24*a* and the central axis of the rotation of the stator 24 coincides with the central axis O, the center of gravity of the stator 24 can be set at the central axis of the rotation of the stator 24. Therefore, the vibration of the stator 24 can be reduced at the time of the rotation of the stator 24. Since whirling of the inner hole 24*a* of the stator 24 does not occur, the volume of the stator 24 can be reduced.

In the fifth drive mechanism 126 of the pump apparatus 125 shown in FIG. 13, one driving portion 130 drives the rotor revolution drive mechanism 132 and the stator rotation drive mechanism 133 to cause the rotor 23 to revolve and cause the stator 24 to rotate. Instead of this, the rotor 23 and the stator 24 may be revolved and rotated by separate driving portions.

Next, the fifth eccentric shaft sealing structure 127 will be explained in reference to FIG. 13. The fifth eccentric shaft sealing structure 127 prevents the transfer fluid from flowing to the rotor revolution drive mechanism 132 and prevents, for example, the lubricant in the rotor revolution drive mechanism 132 from getting mixed in the transfer fluid. A diaphragm 153 can seal a gap formed between the inner peripheral surface of the casing 136 and an outer peripheral surface of the rotor shaft 143.

As shown in FIG. 13, the diaphragm 153 is attached such that an outer peripheral edge portion 153*a* thereof is hermetically fixed to the inner peripheral surface of the casing 136. Then, an inner peripheral edge portion 153*b* of the diaphragm 153 hermetically contacts the outer peripheral surface of the rotor shaft 143. In this state, the rotor shaft 143 is fixedly attached to the inner peripheral edge portion 153*b* of the diaphragm 153. Therefore, the transfer fluid can be prevented from flowing to the rotor revolution drive mechanism 132 and, for example, the lubricant in the rotor revolution drive mechanism 132 can be prevented from getting mixed in the transfer fluid.

Next, the cooled seal portion 128 will be explained in reference to FIG. 13. The cooled seal portion 128 prevents the transfer fluid from flowing to the stator rotation drive mechanism 133 and prevents, for example, the lubricant in the stator rotation drive mechanism 133 from getting mixed in the transfer fluid. The cooled seal portion 128 can seal the gap formed between the inner peripheral surface of the casing 136 and, for example, an end surface of the stator 24.

As shown in FIG. 13, the cooled seal portion 128 includes a fixed seal portion 154 and a rotating seal portion 155, both of which are made of, for example, cemented carbide or ceramics. The fixed seal portion 154 is attached such that a base end edge portion thereof is hermetically fixed to the inner peripheral surface of the casing 136. The rotating seal portion 155 is attached such that a base end edge portion thereof is hermetically fixed to an end portion of the stator 24. Further, a tip end edge portion 154*a* of the fixed seal portion 154 hermetically contacts a tip end edge portion 155*a* of the rotating seal portion 155. In this state, the rotating seal portion 155 is rotatable by the stator 24. With this, the transfer fluid can be prevented from flowing to the stator rotation drive mechanism 133, i.e., the bearing 150, and for example, the lubricant in the stator rotation drive mechanism 133 can be prevented from getting mixed in the transfer fluid.

In the cooled seal portion 128, since the tip end edge portion of the fixed seal portion 154 hermetically contacts the tip end edge portion of the rotating seal portion 155, the rotation of the rotating seal portion 155 generates frictional heat between the tip end edge portion of the fixed seal portion 154 and the tip end edge portion of the rotating seal portion 155. However, the frictional heat can be cooled down by a cooling medium (such as a gas or a liquid) supplied through the cooling port 129. The cooling port 129 is provided at a portion of the casing 136 which portion is located on the stator rotation drive mechanism 133 side of the cooled seal portion 128.

Therefore, the cooled seal portion 128 and the bearing 150 can be prevented from being heated. With this, the lives of the cooled seal portion 128 and the bearing 150 can be lengthened, and a need for maintaining and checking the cooled seal portion 128 and the bearing 150 can be reduced. Moreover, the cooled seal portion 128 can be prevented from increasing in temperature by the frictional heat. Therefore, even if the transfer fluid contains the fine particles, the fine particles can be prevented from being fixedly attached by the frictional heat to a contact portion where the tip end edge portion of the fixed seal portion 154 and the tip end edge portion of the rotating seal portion 155 contact each other.

Next, Embodiment 7 of the pump apparatus including the rotor drive mechanism according to the present invention will be explained in reference to, for example, FIG. 14. A pump apparatus 157 of Embodiment 7 shown in FIG. 14 and the pump apparatus 125 of Embodiment 6 shown in FIG. 13 are different from each other in that Embodiment 6 shown in FIG. 13 includes the fifth drive mechanism 126 and Embodiment 7 shown in FIG. 14 includes a sixth drive mechanism 158.

To be specific, in the fifth drive mechanism 126 of Embodiment 6 shown in FIG. 13, the eccentric shaft 141 provided at a base end portion of the rotor 23 is revolved in a state where the eccentric shaft 141 is revolvably supported by the rotor revolution drive mechanism 132. In the sixth drive mechanism 158 of Embodiment 7 shown in FIG. 14, the eccentric shafts 141 are respectively provided at the base end portion and tip end portion of the rotor 23, and the eccentric shafts 141 are revolved in a state where the eccentric shafts 141 are revolvably supported by the rotor revolution drive mechanisms 132, respectively.

In Embodiment 6 shown in FIG. 13, the transfer fluid is suctioned from the second opening 47 of the casing 136, flows through the inner hole 24*a* of the stator 24 and the passage 152 formed inside the rotor 23 and the eccentric shaft 141, and is discharged from the first opening 46 formed at the left end portion of the eccentric shaft 141. In Embodiment 7 shown in FIG. 14, the transfer fluid is suctioned from the second opening 47 of the casing 136, flows through the inner hole 24*a* of the stator 24, and is discharged from a first opening 159 of the casing 136. Herein, the passage is closed.

Moreover, since the casing 136 is provided with the first opening 159 in Embodiment 7 shown in FIG. 14, the cooled seal portion 128 is additionally provided to, for example, prevent the transfer fluid, flowing through a space 160 communicated with the first opening 159, from flowing in the stator rotation drive mechanism 133. Then, the fifth eccentric shaft sealing structure 127 is also additionally provided to, for example, prevent the transfer fluid from flowing in the rotor revolution drive mechanism 132. Moreover, the cooling port 129 is additionally provided in the vicinity of the first opening 159. The cooling port 129 is provided to supply the cooling medium for cooling down the cooled seal portion 128 provided on the tip end side of the rotor 23.

As shown in FIG. 14, the cooled seal portion 128, the fifth eccentric shaft sealing structure 127, and the cooling port 129 additionally provided on the tip end side of the rotor 23 are equivalent to the cooled seal portion 128, the fifth eccentric shaft sealing structure 127, and the cooling port 129 provided on the base end side of the rotor 23 of Embodiment 6 shown in FIG. 13, so that the same reference numbers are used, and a repetition of the same explanation is avoided. Other than the above, the pump apparatus 157 of Embodiment 7 is the same as the pump apparatus 125 of Embodiment 6 shown in FIG. 13, so that the same reference numbers are used for the same components, and a repetition of the same explanation is avoided.

The pump apparatuses 39, etc. of Embodiments 1 to 7 can cause the rotor 23 to carry out the revolution movement while rotating or not rotating the rotor 23 in a state where the outer peripheral surface of the rotor 23 and the inner peripheral surface of the stator inner hole 24*a* shown in FIGS. 1 to 14 do not contact each other or in a state where these surfaces contact each other at a predetermined intensity. However, in the case of causing the rotor 23 to carry out, for example, the revolution movement in a state where the outer peripheral surface of the rotor 23 and the inner peripheral surface of the stator inner hole 24*a* contact each other at a predetermined intensity, the rotor 23 may be caused to carry out the revolution movement while being rotated or not rotated such that one of parallel inner surfaces of the stator inner hole 24*a* and the rotor 23 contact each other at a predetermined appropriate intensity, and the other parallel inner surface of the stator inner hole 24*a* and the rotor 23 do not contact each other. With this, the fluid can be transferred and filled with high flow rate accuracy, low pulsation, and a long operating life.

Moreover, the pump apparatuses 39, etc. of Embodiments 1 to 7 can cause the rotor 23 to rotate at a constant speed or cause the rotor 23 and the stator 24 to rotate at a constant speed to transfer the fluid with low pulsation. Therefore, for example, by periodically changing the rotating speed of the rotor 23 or the rotating speeds of the rotor 23 and the stator 24, the transfer fluid can be pulsated with a desired period and intensity to be transferred.

Further, in the pump apparatuses 39, etc, of Embodiments 1 to 7, the stator 24 is made of engineering plastic, such as TEFLON (trademark). However, the stator 24 may be made of, for example, synthetic rubber or a metal. Then, the rotor 23 may be made of engineering plastic, such as TEFLON (trademark).

As shown in FIGS. 13 and 14, in the pump apparatuses 125 and 157 of Embodiments 6 and 7, the cooled seal portion 128 is cooled down by the cooling medium. Although not shown, instead of the cooling medium, the cooled seal portion 128 may be cooled down by a cooling electron element, such as a Peltier element. The cooling electron element may be configured to be attached to the fixed seal portion 154, for example. Then, the heat generated by the cooling electron element can be exhausted from the cooling port.

INDUSTRIAL APPLICABILITY

As above, the rotor drive mechanism, the eccentric shaft sealing structure, and the pump apparatus according to the present invention has excellent effects of being able to transfer and fill the fluid with high flow rate accuracy and a long operating life and realizing small size, light weight, low cost, and energy saving. Therefore, the present invention is applicable to such rotor drive mechanism, eccentric shaft sealing structure, and pump apparatus.

The invention claimed is:

1. A rotor drive mechanism configured to transfer rotation of an input shaft portion to an output shaft portion coupled to an external screw type rotor of a uniaxial eccentric screw pump, the input shaft portion being rotated with a central axis thereof kept in a certain position, wherein:

the output shaft portion is rotatably provided via a bearing at a position eccentrically located with respect to the input shaft portion;

the rotation of the input shaft portion is transferred through a power transmission mechanism including an inner gear to the output shaft portion to cause the output shaft portion to carry out an eccentric rotational movement; and the input shaft portion and the output shaft portion are arranged inside a pitch circle of the inner gear.

2. The rotor drive mechanism according to claim 1, further comprising an eccentric shaft sealing structure configured to seal a gap between an eccentric shaft configured as the output shaft portion to carry out the eccentric rotational movement and a casing having a large-diameter hole through which the eccentric shaft is inserted to carry out the eccentric rotational movement, wherein a gap between an outer peripheral portion of the eccentric shaft and an inner peripheral portion of the large-diameter hole is sealed by at least a diaphragm.

3. The rotor drive mechanism according to claim 2, further comprising a circular coupling portion having a small-diameter hole through which the eccentric shaft is rotatably inserted, wherein:

a gap between the outer peripheral portion of the eccentric shaft and an inner peripheral portion of the circular coupling portion is sealed by a third seal portion; and a gap between an outer peripheral portion of the circular coupling portion and the inner peripheral portion of the large-diameter hole is sealed by the diaphragm.

4. A pump apparatus comprising:

a uniaxial eccentric screw pump; and a rotor drive mechanism configured to transfer rotation of an input shaft portion to an output shaft portion coupled to an external screw type rotor of the uniaxial eccentric screw pump, the input shaft portion being rotated with a central axis thereof kept in a certain position;

wherein the output shaft portion is rotatably provided via a bearing at a position eccentrically located with respect to the input shaft portion;

wherein the rotation of the input shaft portion is transferred through a power transmission mechanism including an inner gear to the output shaft portion to cause the output shaft portion to carry out an eccentric rotational movement;

wherein the input shaft portion and the output shaft portion are arranged inside a pitch circle of the inner gear;

wherein the external screw type rotor is rotatably attached to an inner hole of a stator; and wherein the rotor drive mechanism causes the external screw type rotor to rotate with the external screw type rotor not contacting an inner surface of the inner hole of the stator.

5. The pump apparatus according to claim 4, wherein:

the output shaft portion is coupled to the external screw type rotor via a flexible rod; and the flexible rod is formed to be deformable such that contact pressure between the external screw type rotor and the inner surface of the inner hole of the stator does not deteriorate a quality of a transfer fluid transferred by the pump apparatus.

6. The pump apparatus according to claim 5, wherein:

the transfer fluid is a liquid containing fine particles;

the flexible rod and the external screw type rotor each include synthetic resin; and the flexible rod is formed to be deformable such that the fine particles are not damaged.

7. A pump apparatus comprising:

a rotor drive mechanism configured to transfer rotation of an input shaft portion to an eccentric shaft coupled to an external screw type rotor of a uniaxial eccentric screw pump, the input shaft portion being rotated with a central axis thereof kept in a certain position, wherein the eccentric shaft is rotatably provided via a bearing at a position eccentrically located with respect to the input shaft portion, wherein the rotation of the input shaft portion is transferred through a power transmission mechanism including an inner gear to the eccentric shaft to cause an output shaft portion to carry out an eccentric rotational movement, and wherein the input shaft portion and the eccentric shaft are arranged inside a pitch circle of the inner gear and an eccentric shaft sealing structure configured to seal a gap between an eccentric shaft and a casing, the eccentric shaft configured to carry out an eccentric rotational movement, and the casing having a large-diameter inner hole through which the eccentric shaft is inserted to carry out the eccentric rotational movement, wherein a gap between an outer peripheral portion of the eccentric shaft and an inner peripheral portion of the large-diameter hole is sealed by at least a diaphragm, and wherein the external screw type rotor is rotatably attached to an inner hole of a stator.

* * * * *